US008018171B1

(12) United States Patent
Melanson et al.

(10) Patent No.: US 8,018,171 B1
(45) Date of Patent: Sep. 13, 2011

(54) MULTI-FUNCTION DUTY CYCLE MODIFIER

(75) Inventors: John L. Melanson, Austin, TX (US); John J. Paulos, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 822 days.

(21) Appl. No.: 12/047,258

(22) Filed: Mar. 12, 2008

Related U.S. Application Data

(60) Provisional application No. 60/894,295, filed on Mar. 12, 2007, provisional application No. 60/909,457, filed on Apr. 1, 2007.

(51) Int. Cl.
*H05B 37/02* (2006.01)

(52) U.S. Cl. ..... 315/194; 315/195; 315/291

(58) Field of Classification Search ..... 315/246, 315/250, 194, 195, 199, 291, 295, DIG. 4
See application file for complete search history.

(56) References Cited

U.S. PATENT DOCUMENTS

| | | | |
|---|---|---|---|
| 3,790,878 | A | 2/1974 | Brokaw |
| 3,881,167 | A | 4/1975 | Pelton et al. |
| 4,075,701 | A | 2/1978 | Hofmann |
| 4,334,250 | A | 6/1982 | Theus |
| 4,414,493 | A | 11/1983 | Henrich |
| 4,476,706 | A | 10/1984 | Hadden et al. |
| 4,677,366 | A | 6/1987 | Wilkinson et al. |
| 4,683,529 | A | 7/1987 | Bucher |
| 4,700,188 | A | 10/1987 | James |
| 4,737,658 | A | 4/1988 | Kronmuller et al. |
| 4,797,633 | A | 1/1989 | Humphrey |
| 4,937,728 | A | 6/1990 | Leonardi |
| 4,940,929 | A | 7/1990 | Williams |
| 4,973,919 | A | 11/1990 | Allfather |
| 4,979,087 | A | 12/1990 | Sellwood et al. |
| 4,980,898 | A | 12/1990 | Silvian |
| 4,992,919 | A | 2/1991 | Lee et al. |
| 4,994,952 | A | 2/1991 | Silva et al. |

(Continued)

FOREIGN PATENT DOCUMENTS

EP 0585789 A1 3/1994

(Continued)

OTHER PUBLICATIONS

Linear Technology, "Single Switch PWM Controller with Auxiliary Boost Converter," LT1950 Datasheet, Linear Technology, Inc. Milpitas, CA, 2003.

(Continued)

*Primary Examiner* — David Hung Vu
(74) *Attorney, Agent, or Firm* — Hamilton & Terrile, LLP; Kent B. Chambers

(57) ABSTRACT

A system and method modify phase delays of a periodic, phase modulated mains voltage to generate at least two independent items of information during each cycle of the periodic input signal. The independent items of information can be generated by, for example, independently modifying leading edge and trailing edge phase delays of each half cycle phase modulated mains voltage. Modifying phase delays for the leading and trailing edges of each half cycle of the phase modulated mains voltage can generate up to four independent items of data. The items of data can be converted into independent control signals to, for example, control drive currents to respective output devices such as light sources to provide multiple items of information per cycle.

16 Claims, 13 Drawing Sheets

U.S. PATENT DOCUMENTS 5,001,620 A 3/1991 Smith
5,109,185 A 4/1992 Ball
5,121,079 A 6/1992 Dargatz
5,206,540 A 4/1993 de Sa e Silva et al.
5,264,780 A 11/1993 Bruer et al.
5,278,490 A 1/1994 Smedley
5,323,157 A 6/1994 Ledzius et al.
5,359,180 A 10/1994 Park et al.
5,383,109 A 1/1995 Maksimovic et al.
5,424,932 A 6/1995 Inou et al.
5,477,481 A 12/1995 Kerth
5,479,333 A 12/1995 McCambridge et al.
5,481,178 A 1/1996 Wilcox et al.
5,565,761 A 10/1996 Hwang
5,589,759 A 12/1996 Borgato et al.
5,638,265 A 6/1997 Gabor
5,691,890 A 11/1997 Hyde
5,747,977 A 5/1998 Hwang
5,757,635 A 5/1998 Seong
5,781,040 A 7/1998 Myers
5,783,909 A 7/1998 Hochstein
5,798,635 A 8/1998 Hwang et al.
5,811,940 A * 9/1998 Nutzel ..... 315/291
5,900,683 A 5/1999 Rinehart et al.
5,929,400 A 7/1999 Colby et al.
5,946,202 A 8/1999 Balogh
5,946,206 A 8/1999 Shimizu et al.
5,952,849 A 9/1999 Haigh et al.
5,963,086 A 10/1999 Hall
5,966,297 A 10/1999 Minegishi
5,994,885 A 11/1999 Wilcox et al.
6,016,038 A 1/2000 Mueller et al.
6,043,633 A 3/2000 Lev et al.
6,072,969 A 6/2000 Yokomori et al.
6,083,276 A 7/2000 Davidson et al.
6,084,450 A 7/2000 Smith et al.
6,150,774 A 11/2000 Mueller et al.
6,181,114 B1 1/2001 Hemena et al.
6,211,626 B1 4/2001 Lys et al.
6,211,627 B1 4/2001 Callahan
6,229,271 B1 5/2001 Liu
6,229,292 B1 5/2001 Redl et al.
6,246,183 B1 6/2001 Buonavita
6,259,614 B1 7/2001 Ribarich et al.
6,300,723 B1 10/2001 Wang et al.
6,304,066 B1 10/2001 Wilcox et al.
6,304,473 B1 10/2001 Telefus et al.
6,343,026 B1 1/2002 Perry
6,344,811 B1 2/2002 Melanson
6,385,063 B1 5/2002 Sadek et al.
6,407,691 B1 6/2002 Yu
6,441,558 B1 8/2002 Muthu et al.
6,445,600 B2 9/2002 Ben-Yaakov
6,452,521 B1 9/2002 Wang
6,469,484 B2 10/2002 L'Hermite et al.
6,495,964 B1 12/2002 Hayes
6,509,913 B2 1/2003 Martin, Jr. et al.
6,580,258 B2 6/2003 Wilcox et al.
6,583,550 B2 6/2003 Iwasa et al.
6,628,106 B1 9/2003 Batarseh et al.
6,636,003 B2 10/2003 Rahm et al.
6,646,848 B2 11/2003 Yoshida et al.
6,713,974 B2 3/2004 Patchornik et al.
6,724,174 B1 4/2004 Esteves et al.
6,727,832 B1 4/2004 Melanson
6,737,845 B2 5/2004 Hwang
6,741,123 B1 5/2004 Melanson et al.
6,753,661 B2 6/2004 Muthu et al.
6,756,772 B2 6/2004 McGinnis
6,768,655 B1 7/2004 Yang et al.
6,781,351 B2 8/2004 Mednik et al.
6,788,011 B2 9/2004 Mueller et al.
6,806,659 B1 10/2004 Mueller et al.
6,839,247 B1 1/2005 Yang
6,860,628 B2 3/2005 Robertson et al.
6,870,325 B2 3/2005 Bushell et al.
6,873,065 B2 3/2005 Haigh et al.
6,882,552 B2 4/2005 Telefus et al.
6,888,322 B2 5/2005 Dowling et al.
6,894,471 B2 5/2005 Corva et al.
6,933,706 B2 8/2005 Shih
6,940,733 B2 9/2005 Schie et al.
6,944,034 B1 9/2005 Shytenberg et al.
6,956,750 B1 10/2005 Eason et al.
6,958,920 B2 10/2005 Mednik et al.
6,963,496 B2 11/2005 Bimbaud
6,967,448 B2 11/2005 Morgan et al.
6,970,503 B1 11/2005 Kalb
6,975,079 B2 12/2005 Lys et al.
6,975,523 B2 12/2005 Kim et al.
6,980,446 B2 12/2005 Simada et al.
7,003,023 B2 2/2006 Krone et al.
7,034,611 B2 4/2006 Oswal et al.
7,050,509 B2 5/2006 Krone et al.
7,064,498 B2 6/2006 Dowling et al.
7,064,531 B1 6/2006 Zinn
7,075,329 B2 7/2006 Chen et al.
7,078,963 B1 7/2006 Andersen et al.
7,088,059 B2 8/2006 McKinney et al.
7,102,902 B1 9/2006 Brown et al.
7,106,603 B1 9/2006 Lin et al.
7,109,791 B1 9/2006 Epperson et al.
7,135,824 B2 11/2006 Lys et al.
7,145,295 B1 12/2006 Lee et al.
7,158,633 B1 1/2007 Hein
7,161,816 B2 1/2007 Shytenberg et al.
7,183,957 B1 2/2007 Melanson
7,221,130 B2 5/2007 Ribeiro et al.
7,233,135 B2 6/2007 Noma et al.
7,255,457 B2 8/2007 Ducharm et al.
7,266,001 B1 9/2007 Notohamiprodjo et al.
7,288,902 B1 10/2007 Melanson
7,292,013 B1 11/2007 Chen et al.
7,310,244 B2 12/2007 Yang et al.
7,345,458 B2 3/2008 Kanai et al.
7,388,764 B2 6/2008 Huynh et al.
7,394,210 B2 7/2008 Ashdown
7,538,499 B2 5/2009 Ashdown
7,545,130 B2 6/2009 Latham
7,554,473 B2 6/2009 Melanson
7,569,996 B2 8/2009 Holmes et al.
7,583,136 B2 9/2009 Pelly
7,656,103 B2 2/2010 Shteynberg et al.
7,710,047 B2 5/2010 Shteynberg et al.
7,719,248 B1 5/2010 Melanson
7,746,043 B2 6/2010 Melanson
7,746,671 B2 6/2010 Radecker et al.
7,750,738 B2 7/2010 Bach
7,804,256 B2 9/2010 Melanson
2002/0145041 A1 10/2002 Muthu et al.
2002/0150151 A1 10/2002 Krone et al.
2002/0166073 A1 11/2002 Nguyen et al.
2003/0095013 A1 5/2003 Melanson et al.
2003/0174520 A1 9/2003 Bimbaud
2003/0223255 A1 12/2003 Ben-Yaakov
2004/0004465 A1 1/2004 McGinnis
2004/0046683 A1 3/2004 Mitamura et al.
2004/0085030 A1 5/2004 Laflamme et al.
2004/0085117 A1 5/2004 Melbert et al.
2004/0169477 A1 9/2004 Yancie et al.
2004/0227571 A1 11/2004 Kuribayashi
2004/0228116 A1 11/2004 Miller et al.
2004/0232971 A1 11/2004 Kawasake et al.
2004/0239262 A1 12/2004 Ido et al.
2005/0057237 A1 3/2005 Clavel
2005/0077840 A1* 4/2005 Kazanov et al. ..... 315/294
2005/0156770 A1 7/2005 Melanson
2005/0168492 A1 8/2005 Hekstra et al.
2005/0184895 A1 8/2005 Petersen et al.
2005/0207190 A1 9/2005 Gritter
2005/0218838 A1 10/2005 Lys
2005/0253533 A1 11/2005 Lys et al.
2005/0270813 A1 12/2005 Zhang et al.
2005/0275354 A1 12/2005 Hausman, Jr. et al.
2005/0275386 A1 12/2005 Jepsen et al.
2006/0022916 A1 2/2006 Aiello
2006/0023002 A1 2/2006 Hara et al.

| | | | | |
|---|---|---|---|---|
| 2006/0125420 | A1 | 6/2006 | Boone et al. | |
| 2006/0214603 | A1 | 9/2006 | Oh et al. | |
| 2006/0226795 | A1 | 10/2006 | Walter et al. | |
| 2006/0261754 | A1 | 11/2006 | Lee | |
| 2006/0285365 | A1 | 12/2006 | Huynh et al. | |
| 2007/0024213 | A1 * | 2/2007 | Shteynberg et al. | 315/291 |
| 2007/0029946 | A1 | 2/2007 | Yu et al. | |
| 2007/0040512 | A1 | 2/2007 | Jungwirth et al. | |
| 2007/0053182 | A1 | 3/2007 | Robertson | |
| 2007/0103949 | A1 | 5/2007 | Tsuruya | |
| 2007/0182699 | A1 | 8/2007 | Ha et al. | |
| 2008/0012502 | A1 | 1/2008 | Lys | |
| 2008/0043504 | A1 | 2/2008 | Ye et al. | |
| 2008/0054815 | A1 | 3/2008 | Kotikalapoodi et al. | |
| 2008/0174291 | A1 | 7/2008 | Hansson et al. | |
| 2008/0174372 | A1 | 7/2008 | Tucker et al. | |
| 2008/0175029 | A1 | 7/2008 | Jung et al. | |
| 2008/0192509 | A1 | 8/2008 | Dhuyvetter et al. | |
| 2008/0224635 | A1 | 9/2008 | Hayes | |
| 2008/0239764 | A1 | 10/2008 | Jacques et al. | |
| 2008/0259655 | A1 | 10/2008 | Wei et al. | |
| 2008/0278132 | A1 | 11/2008 | Kesterson et al. | |
| 2009/0067204 | A1 | 3/2009 | Ye et al. | |
| 2009/0147544 | A1 | 6/2009 | Melanson | |
| 2009/0174479 | A1 | 7/2009 | Yan et al. | |
| 2009/0218960 | A1 | 9/2009 | Lyons et al. | |

FOREIGN PATENT DOCUMENTS

| | | | |
|---|---|---|---|
| EP | 0910168 | A1 | 4/1999 |
| EP | 1014563 | | 6/2000 |
| EP | 1164819 | A | 12/2001 |
| EP | 1213823 | A2 | 6/2002 |
| EP | 1528785 | A | 5/2005 |
| EP | 2204905 | A1 | 7/2010 |
| WO | 01/97384 | A | 12/2001 |
| WO | 0227944 | | 4/2002 |
| WO | 02/091805 | A2 | 11/2002 |
| WO | WO 2006/022107 | A2 | 3/2006 |
| WO | 2006/067521 | A | 6/2006 |
| WO | WO2006135584 | | 12/2006 |
| WO | 2007/026170 | A | 3/2007 |
| WO | 2007/079362 | A | 7/2007 |

OTHER PUBLICATIONS

Yu, Zhenyu, 3.3V DSP for Digital Motor Control, Texas Instruments, Application Report SPRA550 dated Jun. 1999.

International Rectifier, Data Sheet No. PD60143-O, Current Sensing Single Channel Driver, El Segundo, CA, dated Sep. 8, 2004.

Balogh, Laszlo, "Design and Application Guide for High Speed MOSFET Gate Drive Circuits" [Online] 2001, Texas Instruments, Inc., SEM-1400, Unitrode Power Supply Design Seminar, Topic II, TI literature No. SLUP133, XP002552367, Retrieved from the Internet: URL:htt/://focus.ti.com/lit/ml/slup169/slup169.pdf the whole document.

"HV9931 Unity Power Factor LED Lamp Driver, Initial Release" 2005, Supertex Inc., Sunnyvale, CA USA.

"AN-H52 Application Note: "HV9931 Unity Power Factor LED Lamp Driver Mar. 7, 2007, Supertex Inc., Sunnyvale, CA, USA.

Dustin Rand et al: "Issues, Models and Solutions for Triac Modulated Phase Dimming of LED Lamps" Power Electronics Specialists Conference, 2007. PESC 2007, IEEE, IEEE, P1, Jun. 1, 2007, pp. 1398-1404.

Spiazzi G et al: "Analysis of a High-Power-Factor Electronic Ballast for High Brightness Light Emitting Diodes" Power Electronics Specialists, 2005 IEEE 36th Conference on Jun. 12, 2005, Piscatawa, NJ USA, IEEE, Jun. 12, 2005, pp. 1494-1499.

International Search Report PCT/US2008/062381 dated Feb. 5, 2008.

International Search Report PCT/US2008/056739 dated Dec. 3, 2008.

Written Opinion of the International Searching Authority PCT/US2008/062381 dated Feb. 5, 2008.

Ben-Yaakov et al, "The Dynamics of a PWM Boost Converter with Resistive Input" IEEE Transactions on Industrial Electronics, IEEE Service Center, Piscataway, NJ, USA, vol. 46, No. 3, Jun. 1, 1999.

International Search Report PCT/US2008/062398 dated Feb. 5, 2008

Partial International Search PCT/US2008/062387 dated Feb. 5, 2008.

Noon, Jim "UC3855A/B High Performance Power Factor Preregulator", Texas Instruments, SLUA146A, May 1996, Revised Apr. 2004.

"High Performance Power Factor Preregulator", Unitrode Products from Texas Instruments, SLUS382B, Jun. 1998, Revised Oct. 2005.

International Search Report PCT/GB2006/003259 dated Jan. 12, 2007 .

International Search Report PCT/US2008/056606 dated Dec. 3, 2008.

Written Opinion of the International Searching Authority PCT/US2008/056606 dated Dec. 3, 2008.

International Search Report PCT/US2008/056608 dated Dec. 3, 2008.

Written Opinion of the International Searching Authority PCT/US2008/056608 dated Dec. 3, 2008.

International Search Report PCT/GB2005/050228 dated Mar. 14, 2006.

International Search PCT/US2008/062387 dated Jan. 10, 2008.

Data Sheet LT3496 Triple Output LED Driver, 2007, Linear Technology Corporation, Milpitas, CA.

Infineon, CCM-PFC Standalone Power Factor Correction (PFC) Controller in Continuous Conduction Mode (CCM), Version 2.1, Feb. 6, 2007.

International Rectifier, IRAC1150-300W Demo Board, User's Guide, Rev 3.0, Aug. 2, 2005.

International Rectifier, Application Note AN-1077,PFC Converter Design with IR1150 One Cycle Control IC, rev. 2.3, Jun. 2005.

International Rectifier, Data Sheet PD60230 revC, Feb. 5, 2007.

Lu et al., International Rectifier, Bridgeless PFC Implementation Using One Cycle Control Technique, 2005.

Linear Technology, LT1248, Power Factor Controller, Apr. 20, 2007.

ON Semiconductor, AND8123/D, Power Factor Correction Stages Operating in Critical Conduction Mode, Sep. 2003.

ON Semiconductor, MC33260, GreenLine Compact Power Factor Controller: Innovative Circuit for Cost Effective Solutions, Sep. 2005.

ON Semiconductor, NCP1605, Enhanced, High Voltage and Efficient Standby Mode, Power Factor Controller, Feb. 2007.

ON Semconductor, NCP1606, Cost Effective Power Factor Controller, Mar. 2007.

ON Semiconductor, NCP1654, Product Review, Power Factor Controller for Compact and Robust, Continuous Conduction Mode Pre-Converters, Mar. 2007.

Philips, Application Note, 90W Resonant SMPS with TEA1610 SwingChip, AN99011, 1999.

NXP, TEA1750, GreenChip III SMPS control IC Product Data Sheet, Apr. 6, 2007.

Renesas, HA16174P/FP, Power Factor Correction Controller IC, Jan. 6, 2006.

Renesas Technology Releases Industry's First Critical-Conduction-Mode Power Factor Correction Control IC Implementing Interleaved Operation, Dec. 18, 2006.

Renesas, Application Note R2A20111 EVB, PFC Control IC R2A20111 Evaluation Board, Feb. 2007.

STMicroelectronics, L6563, Advanced Transition-Mode PFC Controller, Mar. 2007.

Texas Instruments, Application Note SLUA321, Startup Current Transient of the Leading Edge Triggered PFC Controllers, Jul. 2004.

Texas Instruments, Application Report, SLUA309A, Avoiding Audible Noise at Light Loads when using Leading Edge Triggered PFC Converters, Sep. 2004.

Texas Instruments, Application Report SLUA369B, 350-W, Two-Phase Interleaved PFC Pre-Regulator Design Review, Mar. 2007.

Unitrode, High Power-Factor Preregulator, Oct. 1994.

Texas Instruments, Transition Mode PFC Controller, SLUS515D, Jul. 2005.

Unitrode Products From Texas Instruments, Programmable Output Power Factor Preregulator, Dec. 2004.

Unitrode Products From Texas Instruments, High Performance Power Factor Preregulator, Oct. 2005.

Texas Instruments, UCC3817 BiCMOS Power Factor Preregulator Evaluation Board User's Guide, Nov. 2002.
Unitrode, L. Balogh, Design Note UC3854A/B and UC3855A/B Provide Power Limiting with Sinusoidal Input Current for PFC Front Ends, SLUA196A, Nov. 2001.
A. Silva De Morais et al., A High Power Factor Ballast Using a Single Switch with Both Power Stages Integrated, IEEE Transactions on Power Electronics, vol. 21, No. 2, Mar. 2006.
M. Ponce et al., High-Efficient Integrated Electronic Ballast for Compact Fluorescent Lamps, IEEE Transactions on Power Electronics, vol. 21, No. 2, Mar. 2006.
A. R. Seidel et al., A Practical Comparison Among High-Power-Factor Electronic Ballasts with Similar Ideas, IEEE Transactions on Industry Applications, vol. 41, No. 6, Nov.-Dec. 2005.
F. T. Wakabayashi et al., An Improved Design Procedure for LCC Resonant Filter of Dimmable Electronic Ballasts for Fluorescent Lamps, Based on Lamp Model, IEEE Transactions on Power Electronics, vol. 20, No. 2, Sep. 2005.
J. A. Vilela Jr. et al., An Electronic Ballast with High Power Factor and Low Voltage Stress, IEEE Transactions on Industry Applications, vol. 41, No. 4, Jul./Aug. 2005.
S. T.S. Lee et al., Use of Saturable Inductor to Improve the Dimming Characteristics of Frequency-Controlled Dimmable Electronic Ballasts, IEEE Transactions on Power Electronics, vol. 19, No. 6, Nov. 2004.
M. K. Kazimierczuk et al., Electronic Ballast for Fluorescent Lamps, IEEETransactions on Power Electronics, vol. 8, No. 4, Oct. 1993.
S. Ben-Yaakov et al., Statics and Dynamics of Fluorescent Lamps Operating at High Frequency: Modeling and Simulation, IEEE Transactions on Industry Applications, vol. 38, No. 6, Nov.-Dec. 2002.
H. L. Cheng et al., A Novel Single-Stage High-Power-Factor Electronic Ballast with Symmetrical Topology, IEEE Transactions on Power Electronics, vol. 50, No. 4, Aug. 2003.
J.W.F. Dorleijn et al., Standardisation of the Static Resistances of Fluorescent Lamp Cathodes and New Data for Preheating, Industry Applications Conference, vol. 1, Oct. 13, 2002-Oct. 18, 2002.
Q. Li et al., An Analysis of the ZVS Two-Inductor Boost Converter under Variable Frequency Operation, IEEE Transactions on Power Electronics, vol. 22, No. 1, Jan. 2007.
H. Peng et al., Modeling of Quantization Effects in Digitally Controlled DC-DC Converters, IEEE Transactions on Power Electronics, vol. 22, No. 1, Jan. 2007.
G. Yao et al., Soft Switching Circuit for Interleaved Boost Converters, IEEE Transactions on Power Electronics, vol. 22, No. 1, Jan. 2007.
C. M. De Oliviera Stein et al., A ZCT Auxiliary Communication Circuit for Interleaved Boost Converters Operating in Critical Conduction Mode, IEEE Transactions on Power Electronics, vol. 17, No. 6, Nov. 2002.
W. Zhang et al., A New Duty Cycle Control Strategy for Power Factor Correction and FPGA Implementation, IEEE Transactions on Power Electronics, vol. 21, No. 6, Nov. 2006.
H. Wu et al., Single Phase Three-Level Power Factor Correction Circuit with Passive Lossless Snubber, IEEE Transactions on Power Electronics, vol. 17, No. 2, Mar. 2006.
O. Garcia et al., High Efficiency PFC Converter to Meet EN61000-3-2 and A14, Proceedings of the 2002 IEEE International Symposium on Industrial Electronics, vol. 3, 2002.
P. Lee et al., Steady-State Analysis of an Interleaved Boost Converter with Coupled Inductors, IEEE Transactions on Industrial Electronics, vol. 47, No. 4, Aug. 2000.
D.K.W. Cheng et al., A New Improved Boost Converter with Ripple Free Input Current Using Coupled Inductors, Power Electronics and Variable Speed Drives, Sep. 21-23, 1998.
B.A. Miwa et al., High Efficiency Power Factor Correction Using Interleaved Techniques, Applied Power Electronics Conference and Exposition, Seventh Annual Conference Proceedings, Feb. 23-27, 1992.
Z. Lai et al., A Family of Power-Factor-Correction Controllers, Twelfth Annual Applied Power Electronics Conference and Exposition, vol. 1, Feb. 23, 1997-Feb. 27, 1997.
L. Balogh et al., Power-Factor Correction with Interleaved Boost Converters in Continuous-Inductor-Current Mode, Eighth Annual Applied Power Electronics Conference and Exposition, 1993. APEC. '93. Conference Proceedings, Mar. 7, 1993-Mar. 11, 1993.
Fairchild Semiconductor, Application Note 42030, Theory and Application of the ML4821 Average Current Mode PFC Controller, Oct. 25, 2000.
Unitrode Products From Texas Instruments, BiCMOS Power Factor Preregulator, Feb. 2006.
D. Hausman, Lutron, RTISS-TE Operation, Real-Time Illumination Stability Systems for Trailing-Edge (Reverse Phase Control) Dimmers, v. 1.0 Dec. 2004.
International Rectifier, Data Sheet No. PD60230 revC, IR1150(S)(PbF), uPFC One Cycle Control PFC IC Feb. 5, 2007.
Texas Instruments, Application Report SLUA308, UCC3817 Current Sense Transformer Evaluation, Feb. 2004.
Texas Instruments, Application Report SPRA902A, Average Current Mode Controlled Power Factor Correctiom Converter using TMS320LF2407A, Jul. 2005.
Unitrode, Design Note DN-39E, Optimizing Performance in UC3854 Power Factor Correction Applications, Nov. 1994.
Fairchild Semiconductor, Application Note 42030, Theory and Application of the ML4821 Average Currrent Mode PFC Controller, Aug. 1997.
Fairchild Semiconductor, Application Note AN4121, Design of Power Factor Correction Circuit Using FAN7527B, Rev.1.0.1, May 30, 2002.
Fairchild Semiconductor, Application Note 6004, 500W Power-Factor-Corrected (PFC) Converter Design with FAN4810, Rev. 1.0.1, Oct. 31, 2003.
Fairchild Semiconductor, FAN4822, ZVA Average Current PFC Controller, Rev. 1.0.1 Aug. 10, 2001.
Fairchild Semiconductor, ML4821, Power Factor Controller, Rev. 1.0.2, Jun. 19, 2001.
Fairchild Semiconductor, ML4812, Power Factor Controller, Rev. 1.0.4, May 31, 2001.
ST Microelectronics, L6574, CFL/TL Ballast Driver Preheat and Dimming, Sep. 2003.
ST Microelectronics, AN993, Application Note, Electronic Ballast with PFC Using L6574 and L6561, May 2004.
Freescale Semiconductor, Inc., Dimmable Light Ballast with Power Factor Correction, Design Reference Manual, DRM067, Rev. 1, Dec. 2005.
J. Zhou et al., Novel Sampling Algorithm for DSP Controlled 2 kW PFC Converter, IEEE Transactions on Power Electronics, vol. 16, No. 2, Mar. 2001.
A. Prodic, Compensator Design and Stability Assessment for Fast Voltage Loops of Power Factor Correction Rectifiers, IEEE Transactions on Power Electronics, vol. 22, No. 5, Sep. 2007.
M. Brkovic et al., "Automatic Current Shaper with Fast Output Regulation and Soft-Switching," S.15.C Power Converters, Telecommunications Energy Conference, 1993.
Dallas Semiconductor, Maxim, "Charge-Pump and Step-Up DC-DC Converter Solutions for Powering White LEDs in Series or Parallel Connections," Apr. 23, 2002 .
Freescale Semiconductor, AN3052, Implementing PFC Average Current Mode Control Using the MC9S12E128, Nov. 2005.
D. Maksimovic et al., "Switching Converters with Wide DC Conversion Range," Institute of Electrical and Electronic Engineer's (IEEE) Transactions on Power Electronics, Jan. 1991.
V. Nguyen et al., "Tracking Control of Buck Converter Using Sliding-Mode with Adaptive Hysteresis," Power Electronics Specialists Conference, 1995. PESC apos; 95 Record., 26th Annual IEEE vol. 2, Issue , Jun. 18-22, 1995 pp. 1086-1093.
S. Zhou et al., "A High Efficiency, Soft Switching DC-DC Converter with Adaptive Current-Ripple Control for Portable Applications," IEEE Transactions on Circuits and Systems—II: Express Briefs, vol. 53, No. 4, Apr. 2006.
K. Leung et al., "Use of State Trajectory Prediction in Hysteresis Control for Achieving Fast Transient Response of the Buck Converter," Circuits and Systems, 2003. ISCAS apos;03. Proceedings of the 2003 International Symposium, vol. 3, Issue , May 25-28, 2003 pp. III-439-III-442 vol. 3.

K. Leung et al., "Dynamic Hysteresis Band Control of the Buck Converter with Fast Transient Response," IEEE Transactions on Circuits and Systems—II: Express Briefs, vol. 52, No. 7, Jul. 2005.

Y. Ohno, Spectral Design Considerations for White LED Color Rendering, Final Manuscript, Optical Engineering, vol. 44, 111302 (2005).

S. Skogstad et al., A Proposed Stability Characterization and Verification Method for High-Order Single-Bit Delta-Sigma Modulators, Norchip Conference, Nov. 2006 http://folk.uio.no/savskogs/pub/A_Proposed_Stability_Characterization.pdf.

J. Turchi, Four Key Steps to Design a Continuous Conduction Mode PFC Stage Using the NCP1653, ON Semiconductor, Publication Order No. AND184/D, Nov. 2004.

Megaman, D or S Dimming ESL, Product News, Mar. 15, 2007.

J. Qian et al., New Charge Pump Power-Factor-Correction Electronic Ballast with a Wide Range of Line Input Voltage, IEEE Transactions on Power Electronics, vol. 14, No. 1, Jan. 1999.

P. Green, A Ballast that can be Dimmed from a Domestic (Phase-Cut) Dimmer, IRPLCFL3 rev. b, International Rectifier, http://www.irf.com/technical-info/refdesigns/cfl-3.pdf, printed Mar. 24, 2007.

J. Qian et al., Charge Pump Power-Factor-Correction Technologies Part II: Ballast Applications, IEEE Transactions on Power Electronics, vol. 15, No. 1, Jan. 2000.

Chromacity Shifts in High-Power White LED Systems due to Different Dimming Methods, Solid-State Lighting, http://www.lrc.rpi.edu/programs/solidstate/completedProjects.asp?ID=76, printed May 3, 2007.

S. Chan et al., Design and Implementation of Dimmable Electronic Ballast Based on Integrated Inductor, IEEE Transactions on Power Electronics, vol. 22, No. 1, Jan. 2007.

M. Madigan et al., Integrated High-Quality Rectifier-Regulators, IEEE Transactions on Industrial Electronics, vol. 46, No. 4, Aug. 1999.

T. Wu et al., Single-Stage Electronic Ballast with Dimming Feature and Unity Power Factor, IEEE Transactions on Power Electronics, vol. 13, No. 3, May 1998.

F. Tao et al., "Single-Stage Power-Factor-Correction Electronic Ballast with a Wide Continuous Dimming Control for Fluorescent Lamps," IEEE Power Electronics Specialists Conference, vol. 2, 2001.

Azoteq, IQS17 Family, IQ Switch®—ProxSense™ Series, Touch Sensor, Load Control and User Interface, IQS17 Datasheet V2.00.doc, Jan. 2007.

C. Dilouie, Introducing the LED Driver, EC&M, Sep. 2004.

S. Lee et al., TRIAC Dimmable Ballast with Power Equalization, IEEE Transactions on Power Electronics, vol. 20, No. 6, Nov. 2005.

L. Gonthier et al., EN55015 Compliant 500W Dimmer with Low-Losses Symmetrical Switches, 2005 European Conference on Power Electronics and Applications, Sep. 2005.

D. Hausman, Real-Time Illumination Stability Systems for Trailing-Edge (Reverse Phase Control) Dimmers, Technical White Paper, Lutron, version 1.0, Dec. 2004, http://www.lutron.com/technical_info/pdf/RTISS-TE.pdf.

Light Dimmer Circuits, www.epanorama.net/documents/lights/lightdimmer.html, printed Mar. 26, 2007.

Light Emitting Diode, http://en.wikipedia.org/wiki/Light-emitting_diode, printed Mar. 27, 2007.

Color Temperature, www.sizes.com/units/color_temperature.htm, printed Mar. 27, 2007.

S. Lee et al., A Novel Electrode Power Profiler for Dimmable Ballasts Using DC Link Voltage and Switching Frequency Controls, IEEE Transactions on Power Electronics, vol. 19, No. 3, May 2004.

Y. Ji et al., Compatibility Testing of Fluorescent Lamp and Ballast Systems, IEEE Transactions on Industry Applications, vol. 35, No. 6, Nov./Dec. 1999.

National Lighting Product Information Program, Specifier Reports, "Dimming Electronic Ballasts," vol. 7, No. 3, Oct. 1999.

Supertex Inc., Buck-based LED Drivers Using the HV9910B, Application Note AN-H48, Dec. 28, 2007.

D. Rand et al., Issues, Models and Solutions for Triac Modulated Phase Dimming of LED Lamps, Power Electronics Specialists Conference, 2007.

Supertex Inc., HV9931 Unity Power Factor LED Lamp Driver, Application Note AN-H52, Mar. 7, 2007.

Supertex Inc., 56W Off-line LED Driver, 120VAC with PFC, 160V, 350mA Load, Dimmer Switch Compatible, DN-H05, Feb. 2007.

ST Microelectronics, Power Factor Corrector L6561, Jun. 2004.

Fairchild Semiconductor, Application Note 42047 Power Factor Correction (PFC) Basics, Rev. 0.9.0 Aug. 19, 2004.

M. Radecker et al., Application of Single-Transistor Smart-Power IC for Fluorescent Lamp Ballast, Thirty-Fourth Annual Industry Applications Conference IEEE, vol. 1, Oct. 3, 1999-Oct. 7, 1999.

M. Rico-Secades et al., Low Cost Electronic Ballast for a 36-W Fluorescent Lamp Based on a Current-Mode-Controlled Boost Inverter for a 120-V DC Bus Power Distribution, IEEE Transactions on Power Electronics, vol. 21, No. 4, Jul. 2006.

Fairchild Semiconductor, FAN4800, Low Start-up Current PFC/PWM Controller Combos, Nov. 2006.

Fairchild Semiconductor, FAN4810, Power Factor Correction Controller, Sep. 24, 2003.

Fairchild Semiconductor, FAN4822, ZVS Average Current PFC Controller, Aug. 10, 2001.

Fairchild Semiconductor, FAN7527B, Power Factor Correction Controller, 2003.

Fairchild Semiconductor, ML4821, Power Factor Controller, Jun. 19, 2001.

Freescale Semiconductor, AN1965, Design of Indirect Power Factor Correction Using 56F800/E, Jul. 2005.

International Search Report for PCT/US2008/051072, mailed Jun. 4, 2008.

ST Datasheet L6562, Transition-Mode PFC Controller, 2005, STMicroelectronics, Geneva, Switzerland.

Maksimovic, Regan Zane and Robert Erickson, Impact of Digital Control in Power Electronics, Proceedings of 2004 International Symposium on Power Semiconductor Devices & Ics, Kitakyushu Apr. 5, 2010, Colorado Power Electronics Center, ECE Department, University of Colorado, Boulder, CO.

Mamano, Bob, "Current Sensing Solutions for Power Supply Designers", Unitrode Seminar Notes SEM1200, 1999.

http://toolbarpdf.com/docs/functions-and-features-of-inverters.html printed on Jan. 20, 2011.

International Search Report and Written Opinion for PCT/US2008/062384 dated Jan. 14, 2008.

S. Dunlap et al., Design of Delta-Sigma Modulated Switching Power Supply, Circuits & Systems, Proceedings of the 1998 IEEE International Symposium, 1998.

Power Integrations, Inc., "TOP200-4/14 TOPSwitch Family Three-terminal Off-line PWM Switch", XP-002524650, Jul. 1996, Sunnyvale, California.

Texas Instruments, SLOS318F, "High-Speed, Low Noise, Fully-Differential I/O Amplifiers," THS4130 and THS4131, US, Jan. 2006.

International Search Report and Written Opinion, PCT US20080062398, dated Feb. 5, 2008.

International Search Report Written Opinion PCT US2008051072, dated Feb. 19, 2007.

International Search Report and Written Opinion, PCT US20080062387, dated Feb. 5, 2008.

International Search Report and Written Opinion, PCT US200900032358, dated Jan. 29, 2009.

Hirota, Atsushi et al, "Analysis of Single Switch Delta-Sigma Modulated Pulse Space Modulation PFC Converter Effectively Using Switching Power Device," IEEE, US, 2002.

Prodic, Aleksandar, "Digital Controller for High-Frequency Rectifiers with Power Factor Correction Suitable for On-Chip Implementation," IEEE, US, 2007.

International Search Report and Written Opinion, PCT US20080062378, dated Feb. 5, 2008.

International Search Report and Written Opinion, PCT US20090032351, dated Jan. 29, 2009.

Erickson, Robert W. et al, "Fundamentals of Power Electronics," Second Edition, Chapter 6, Boulder, CO, 2001.
Allegro Microsystems, A1442, "Low Voltage Full Bridge Brushless DC Motor Driver with Hall Commutation and Soft-Switching, and Reverse Battery, Short Circuit, and Thermal Shutdown Protection," Worcester MA, 2009.
Texas Instruments, SLUS828B, "8-Pin Continuous Conduction Mode (CCM) PFC Controller", UCC28019A, US, revised Apr. 2009.
Analog Devices, "120 kHz Bandwidth, Low Distortion, Isolation Amplifier", AD215, Norwood, MA, 1996.
Burr-Brown, ISO120 and ISO121, "Precision Los Cost Isolation Amplifier," Tucson AZ, Mar. 1992.
Burr-Brown, ISO130, "High IMR, Low Cost Isolation Amplifier," SBOS220, US, Oct. 2001.
Prodic, A. et al, "Dead Zone Digital Controller for Improved Dynamic Response of Power Factor Preregulators," IEEE, 2003.
International Search Report and Written Opinion PCT US20080062428 dated Feb. 5, 2008.
PCT US2009/051746, International Search Report and Written Opinion dated Sep. 1, 2009.
PCT US09/51757, International Search Report and Written Opinion dated Aug. 28, 2009.

* cited by examiner

MULTI-FUNCTION DUTY CYCLE MODIFIER

This application claims the benefit under 35 U.S.C. §119 (e) and 37 C.F.R. §1.78 of U.S. Provisional Application No. 60/894,295, filed Mar. 12, 2007 and entitled "Lighting Fixture". U.S. Provisional Application No. 60/894,295 includes exemplary systems and methods and is incorporated by reference in its entirety.

This application claims the benefit under 35 U.S.C. §119 (e) and 37 C.F.R. §1.78 of U.S. Provisional Application No. 60/909,457, entitled "Multi-Function Duty Cycle Modifier," inventors John L. Melanson and John Paulos, and filed on Apr. 1, 2007 describes exemplary methods and systems and is incorporated by reference in its entirety. Referred to herein as Melanson I.

U.S. patent application Ser. No. 12/047,249, entitled "Ballast for Light Emitting Diode Light Sources," inventor John L. Melanson, and filed on Mar. 12, 2008 describes exemplary methods and systems and is incorporated by reference in its entirety. Referred to herein as Melanson II.

U.S. patent application Ser. No. 11/926,864, entitled "Color Variations in a Dimmable Lighting Device with Stable Color Temperature Light Sources," inventor John L. Melanson, and filed on Mar. 31, 2007 describes exemplary methods and systems and is incorporated by reference in its entirety.

This application also claims the benefit under 35 U.S.C. §119(e) of U.S. Provisional Application 60/909,457 entitled "Multi-Function Duty Cycle Modifier", inventors John L. Melanson and John Paulos, and filed on Mar. 31, 2007 describes exemplary methods and systems and is incorporated by reference in its entirety.

U.S. patent application Ser. No. 11/695,024, entitled "Lighting System with Lighting Dimmer Output Mapping," inventors John L. Melanson and John Paulos, and filed on Mar. 31, 2007 describes exemplary methods and systems and is incorporated by reference in its entirety. Referred to herein as Melanson III.

U.S. patent application Ser. No. 11/864,366, entitled "Time-Based Control of a System having Integration Response," inventor John L. Melanson, and filed on Sep. 28, 2007 describes exemplary methods and systems and is incorporated by reference in its entirety. Referred to herein as Melanson IV.

U.S. patent application Ser. No. 11/967,269, entitled "Power Control System Using a Nonlinear Delta-Sigma Modulator with Nonlinear Power Conversion Process Modeling," inventor John L. Melanson, and filed on Dec. 31, 2007 describes exemplary methods and systems and is incorporated by reference in its entirety. Referred to herein as Melanson V.

U.S. patent application Ser. No. 11/967,275, entitled "Programmable Power Control System," inventor John L. Melanson, and filed on Dec. 31, 2007 describes exemplary methods and systems and is incorporated by reference in its entirety. Referred to herein as Melanson VI.

U.S. patent application Ser. No. 12/047,262, entitled "Power Control System for Voltage Regulated Light Sources," inventor John L. Melanson, and filed on Mar. 12, 2008 describes exemplary methods and systems and is incorporated by reference in its entirety. Referred to herein as Melanson VII.

U.S. patent application Ser. No. 12/047,262, entitled "Lighting System with Power Factor Correction Control Data Determined from a Phase Modulated Signal," inventor John L. Melanson, and filed on Mar. 12, 2008 describes exemplary methods and systems and is incorporated by reference in its entirety.

BACKGROUND OF THE INVENTION

1. Field of the Invention

The present invention relates in general to the field of electronics, and more specifically to a system and method for utilizing and generating a phase modulated output signal having multiple, independently generated phase delays per cycle of the phase modulated output signal.

2. Description of the Related Art

Commercially practical incandescent light bulbs have been available for over 100 years. However, other light sources show promise as commercially viable alternatives to the incandescent light bulb. LEDs are becoming particularly attractive as main stream light sources in part because of energy savings through high efficiency light output and environmental incentives such as the reduction of mercury.

LEDs are semiconductor devices and are driven by direct current. The lumen output intensity (i.e. brightness) of the LED approximately varies in direct proportion to the current flowing through the LED. Thus, increasing current supplied to an LED increases the intensity of the LED and decreasing current supplied to the LED dims the LED. Current can be modified by either directly reducing the direct current level to the white LEDs or by reducing the average current through duty cycle modulation.

Dimming a light source saves energy when operating a light source and also allows a user to adjust the intensity of the light source to a desired level. Many facilities, such as homes and buildings, include light source dimming circuits (referred to herein as "dimmers").

FIG. 1 depicts a lighting circuit 100 with a conventional dimmer 102 for dimming incandescent light source 104 in response to inputs to variable resistor 106. The dimmer 102, light source 104, and voltage source 108 are connected in series. Voltage source 108 supplies alternating current at mains voltage $V_{mains}$. The mains voltage $V_{mains}$ can vary depending upon geographic location. The mains voltage $V_{mains}$ is typically 120 $V_{AC}$ (Alternating Current) with a typical frequency of 60 Hz or 230 $V_{AC}$ with a typical frequency of 50 Hz. Instead of diverting energy from the light source 104 into a resistor, dimmer 102 switches the light source 104 off and on many times every second to reduce the total amount of energy provided to light source 104. A user can select the resistance of variable resistor 106 and, thus, adjust the charge time of capacitor 110. A second, fixed resistor 112 provides a minimum resistance when the variable resistor 106 is set to 0 ohms. When capacitor 110 charges to a voltage greater than a trigger voltage of diac 114, the diac 114 conducts and the gate of triac 116 charges. The resulting voltage at the gate of triac 116 and across bias resistor 118 causes the triac 116 to conduct. When the current I passes through zero, the triac 116 becomes nonconductive, i.e. turns 'off'. When the triac 116 is nonconductive, the dimmer output voltage $V_{DIM}$ is 0 V. When triac 116 conducts, the dimmer output voltage $V_{DIM}$ equals the mains voltage $V_{mains}$. The charge time of capacitor 110 required to charge capacitor 110 to a voltage sufficient to trigger diac 114 depends upon the value of current I. The value of current I depends upon the resistance of variable resistor 106 and resistor 112. Thus, adjusting the resistance of variable resistor 106 adjusts the phase angle of dimmer output voltage $V_{DIM}$. Adjusting the phase angle of dimmer output voltage $V_{DIM}$ is equivalent to adjusting the phase angle of dimmer output voltage $V_{DIM}$. Adjusting the phase angle of dimmer output voltage $V_{DIM}$ adjusts the average power to light source 104, which adjusts the intensity of light source 104. The term "phase angle" is also commonly referred to as a "phase delay". Thus, adjusting the phase angle of dimmer output voltage $V_{DIM}$ can also be referred to as adjusting the phase delay of dimmer output signal $V_{DIM}$. Dimmer 102 only modifies the leading edge of each half cycle of voltage $V_{mains}$.

FIG. 2 depicts the periodic dimmer output voltage $V_{DIM}$ waveform of dimmer 102. The dimmer output voltage fluctuates during each period from a positive voltage to a negative voltage. (The positive and negative voltages are characterized with respect to a reference to a direct current (dc) voltage level, such as a neutral or common voltage reference.) The period of each full cycle 202.0 through 202.N is the same as 1/frequency as voltage $V_{mains}$, where N is an integer. The dimmer 102 chops the voltage half cycles 204.0 through 204.N and 206.0 through 206.N to alter the duty cycle of each half cycle. The dimmer 102 chops the first half cycle 204.0 (e.g. positive half cycle) at time $t_1$ so that half cycle 204.0 is 0 V from time $t_0$ through time $t_1$ and has a positive voltage from time $t_1$ to time $t_2$. The light source 104 is, thus, turned 'off' from times $t_0$ through $t_1$ and turned 'on' from times $t_1$ through $t_2$. Dimmer 102 chops the first half cycle 206.0 with the same timing as the second half cycle 204.0 (e.g. negative half cycle). So, the duty cycles of each half cycle of cycle 202.0 are the same. Thus, the full duty cycle of dimmer 102 for cycle 202.0 is represented by Equation [1]:

$$\text{Duty Cycle} = \frac{(t_2 - t_1)}{(t_2 - t_0)}. \quad [1]$$

When the resistance of variable resistance 106 is increased, the duty cycle of dimmer 102 decreases. Between time $t_2$ and time $t_3$, the resistance of variable resistance 106 is increased, and, thus, dimmer 102 chops the full cycle 202.N at later times in the first half cycle 204.N and the second half cycle 206.N of the full cycle 202.N with respect to cycle 202.0. Dimmer 102 continues to chop the first half cycle 204.N with the same timing as the second half cycle 206.N. So, the duty cycles of each half cycle of cycle 202.N are the same. Thus, the full duty cycle of dimmer 102 for cycle 202.N is:

$$\text{Duty Cycle} = \frac{(t_5 - t_4)}{(t_5 - t_3)}. \quad [2]$$

Since times $(t_5-t_4)<(t_2-t_1)$, less average power is delivered to light source 104 by the sine wave 202.N of dimmer voltage $V_{DIM}$, and the intensity of light source 104 decreases at time $t_3$ relative to the intensity at time $t_2$.

The voltage and current fluctuations of conventional dimmer circuits, such as dimmer 102, can destroy LEDs. U.S. Pat. No. 7,102,902, filed Feb. 17, 2005, inventors Emery Brown and Lodhie Pervaiz, and entitled "Dimmer Circuit for LED" (referred to here as the "Brown patent") describes a circuit that supplies a specialized load to a conventional AC dimmer which, in turn, controls a LED device. The Brown patent describes dimming the LED by adjusting the duty cycle of the voltage and current provided to the load and providing a minimum load to the dimmer to allow dimmer current to go to zero.

Exemplary modification of leading edges and trailing edges of dimmer signals is discussed in "Real-Time Illumination Stability Systems for Trailing-Edge (Reverse Phase Control) Dimmers" by Don Hausman, Lutron Electronics Co., Inc. of Coopersburg, Pa., U.S.A., Technical White Paper, December 2004 ("Hausman Article), and in U.S. Patent Application Publication, 2005/0275354, entitled "Apparatus and Methods for Regulating Delivery of Electrical Energy", filed Jun. 10, 2004, inventors Hausman, et al. ("Hausman Publication") Both the Hausman Article and Hausman Publication are incorporated herein by reference in their entireties.

Thus, conventional dimmers provide dependently generated phase delays per cycle of a phase modulated signal.

SUMMARY OF THE INVENTION

In one embodiment of the present invention, an apparatus to generate at least two independent signals in response to at least two independent items of information derived from at least two independently generated phase delays per cycle of a phase modulated mains voltage signal includes a phase delay detector to detect at least two independently generated phase delays per cycle of the phase modulated mains voltage signal and to generate respective data signals. Each data signal represents an item of information conforming to one of the phase delays. The apparatus further includes a controller, coupled to the phase delay detector, to receive the data signals and, for each received data signal, to generate a control signal in conformity with the item of information represented by the data signal.

In another embodiment of the present invention, a method to generate at least two independent signals in response to at least two independent items of information derived from at least two independently generated phase delays per cycle of a phase modulated mains voltage signal includes detecting at least two independent phase delays per cycle of the phase modulated mains voltage signal. Each phase delay represents an independent item of information. The method further includes generating respective data signals. Each data signal represents an item of information conforming to one of the phase delays; and for each data signal. The method also includes generating a control signal in conformity with the item of information represented by the data signal.

An apparatus includes a dimming control to receive at least two respective inputs representing respective dimming levels and a dimming signal generator, coupled to the dimming control, to generate a phase modulated output signal having at least two independently generated phase delays per cycle of the phase modulated mains voltage signal. Each dimming level is represented by one of the phase delays.

In another embodiment of the present invention, a method includes receiving at least two respective inputs representing respective dimming levels and independently generating at least two phase delays per cycle in a mains voltage signal to generate a phase modulated output signal. Each phase delay per cycle represents a respective dimming level.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A system and method modify phase delays of a periodic, phase modulated mains voltage to generate at least two independent items of information during each cycle of the periodic input signal. The independent items of information can be generated by, for example, independently modifying leading edge and trailing edge phase delays of each half cycle phase modulated mains voltage. Modifying phase delays for the leading and trailing edges of each half cycle of the phase modulated mains voltage can generate up to four independent items of data. The items of data can be converted into independent control signals to, for example, control drive currents to respective output devices such as light sources. In at least one embodiment, a dimmer generates the phase delays of the mains voltage to generate the phase modulated mains voltage. The phase delays can be converted into current drive signals to independently control the intensity of at least two different sets of lights, such as respective sets of light emitting diodes (LEDs).

Figure 1:
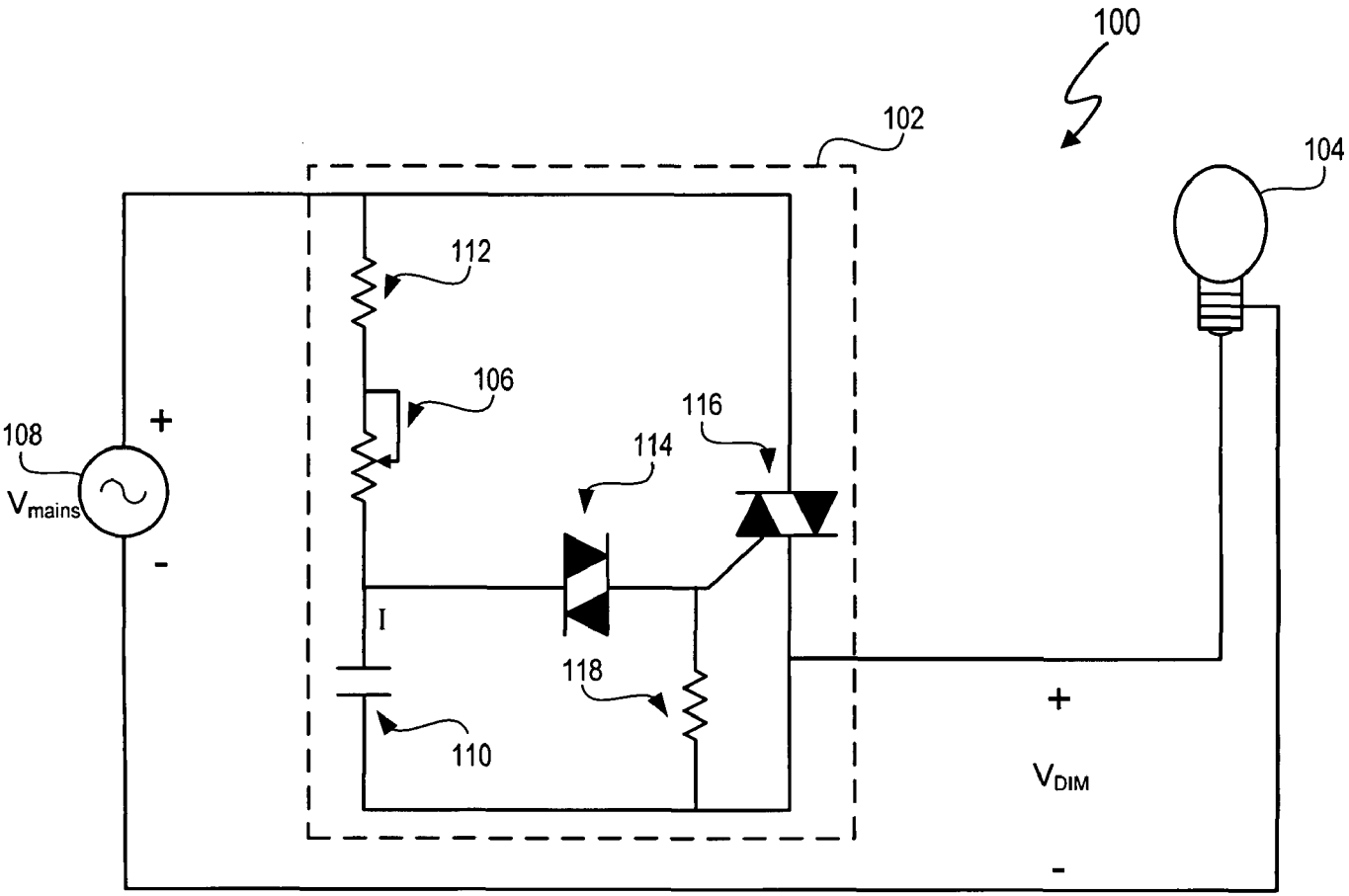
Figure 1 (prior art)
FIG. 1 (labeled prior art) depicts a lighting circuit with a conventional dimmer for dimming an incandescent light source.
Figure 2:
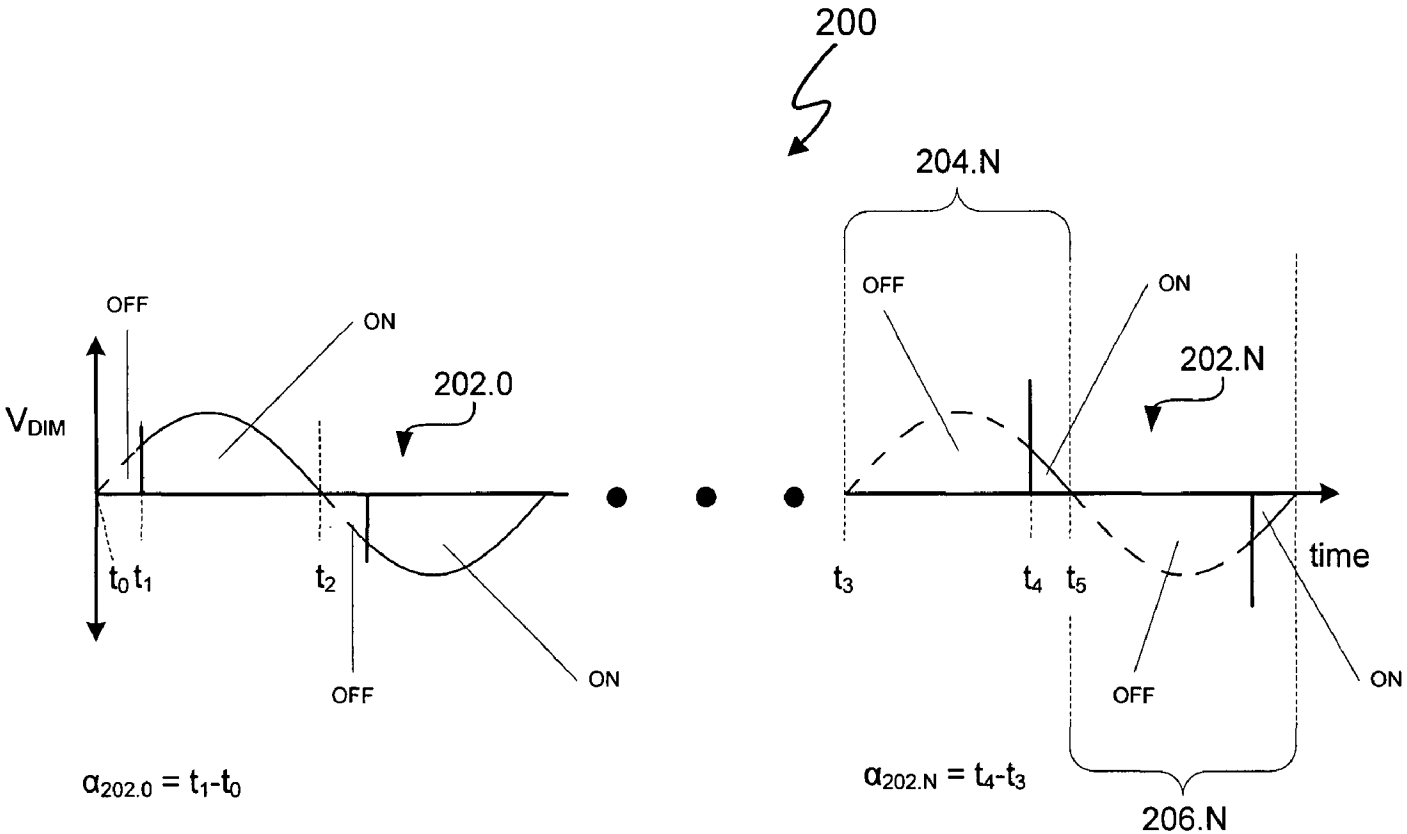
Figure 2 (prior art)
FIG. 2 (labeled prior art) depicts a dimmer circuit output voltage waveform.
Figure 3A:
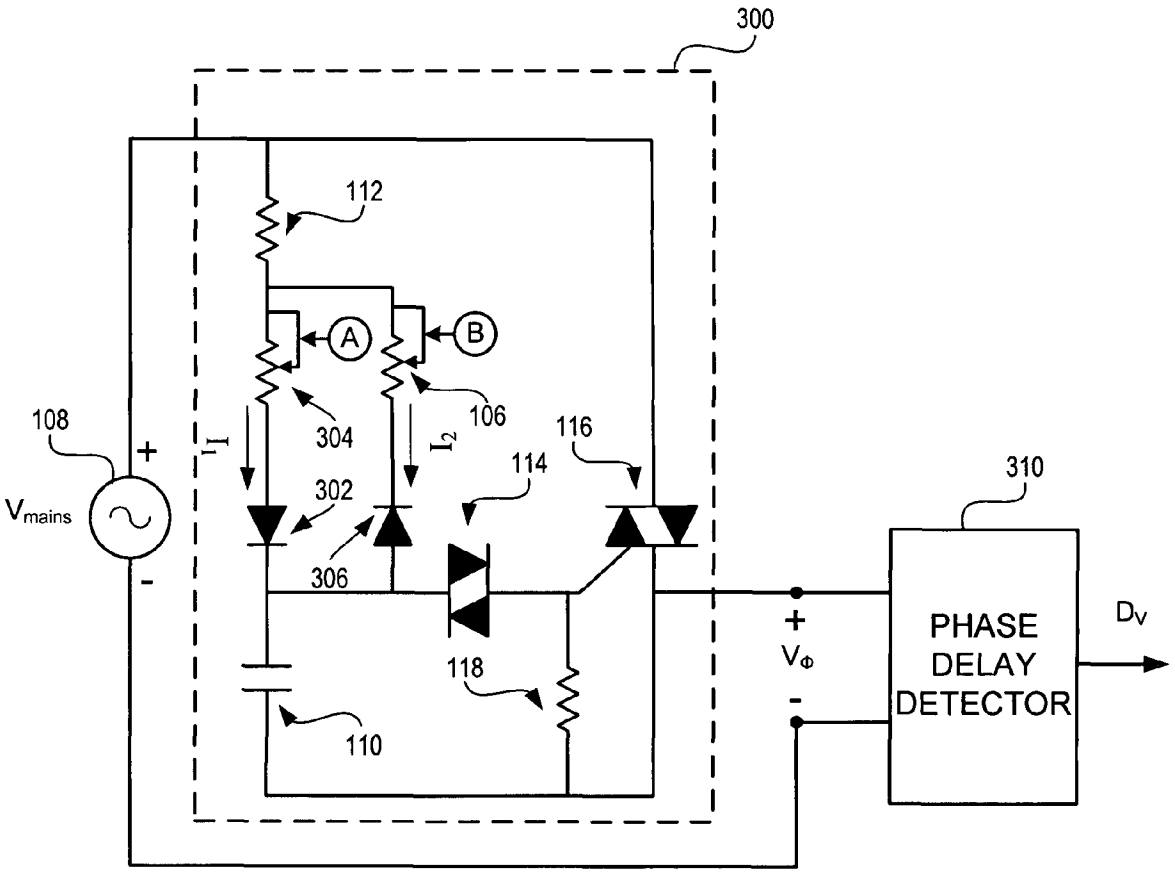
FIG. 3A depicts a duty cycle modifier.

FIG. 3A depicts a phase modulator 300 that chops the leading and/or trailing edges of the positive and/or negative half cycle of AC mains voltage $V_{mains}$ to generate a phase modulated output signal $V_{\Phi}$. The mains voltage $V_{mains}$ is generally supplied by a power station or other AC voltage source. The mains voltage $V_{mains}$ is typically 120 $V_{AC}$ with a typical frequency of 60 Hz or 230 $V_{AC}$ with a typical frequency of 50 Hz. Each cycle of mains voltage $V_{mains}$ has a first half cycle and a second half cycle. In at least one embodiment, the two half cycles are respectively referred to as a positive half cycle and a negative half cycle. "Positive" and "negative" reflect the relationship between the cycle halves and do not necessarily reflect positive and negative voltages.

The phase modulator 300 generates between 2 to 4 phase delays for each full cycle of the phase mains voltage $V_{\Phi}$. At least two of the phase delays per cycle are independently generated. An independently generated phase delay represents a separate item of information from any other phase delay in the same cycle. A dependently generated phase delay redundantly represents an item of information represented by another phase delay in the same cycle, either in the same half cycle or a different half cycle.

In at least one embodiment, phase delays are divided into four categories. Positive half cycle leading edge phase delays and trailing edge phase delays represent two of the categories, and negative half cycle leading edge and trailing edge phase delays represent two additional categories. The positive half cycle phase delays occur in the positive half cycle, and the negative half cycle phase delays occur in the negative half cycle. The leading edge phase delays represent the elapsed time between a beginning of a half cycle and a leading edge of the phase modulated mains voltage $V_{\Phi}$. The trailing edge phase delays represent the elapsed time between a trailing edge of the phase modulated mains voltage $V_{\Phi}$ and the end of a half cycle. Phase delays may be dependently or independently generated. The half cycles are separated by the zero crossings of the original, undimmed mains voltage $V_{mains}$.

Figure 4A:
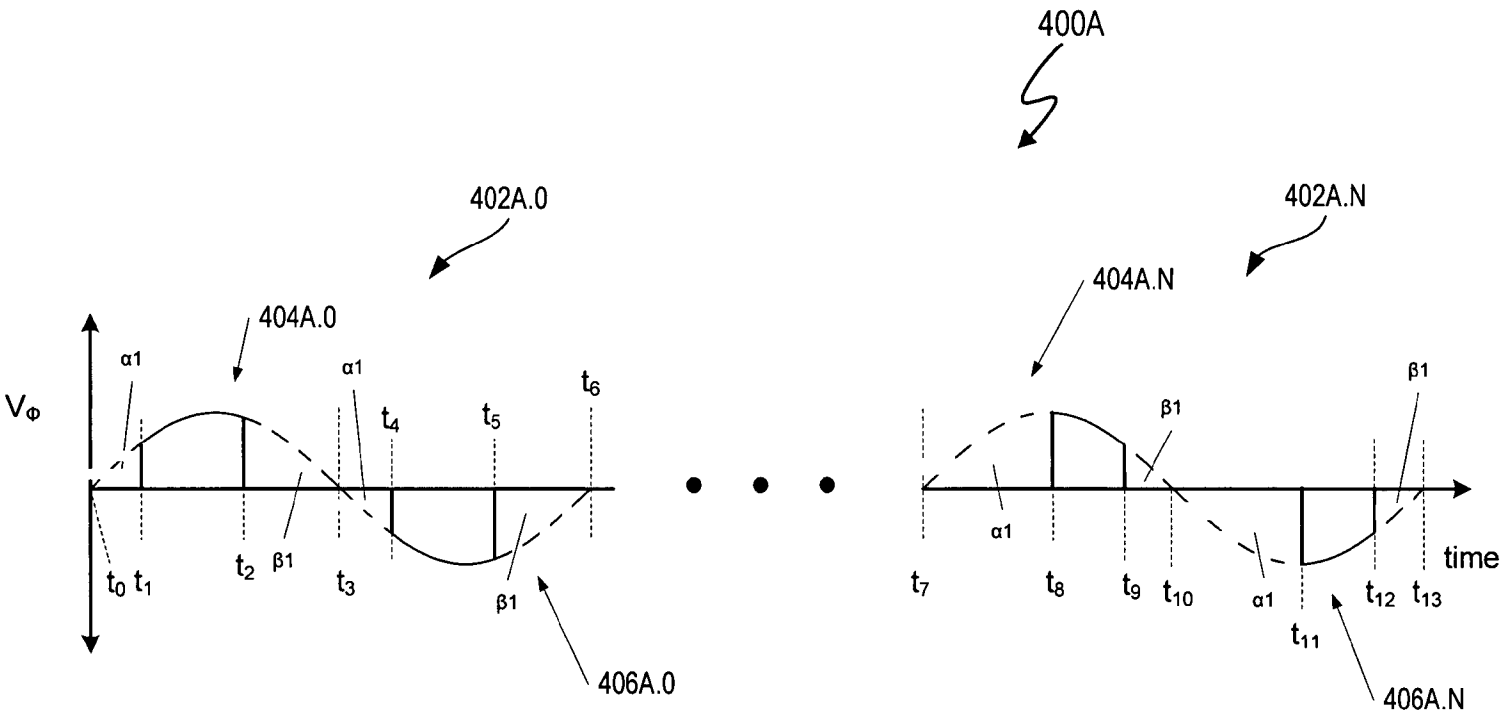
FIGS. 4A-4D depict a waveform with independently generated phased delays per cycle of a phase modulated signal.

Referring to FIGS. 3A and 4A, in at least one embodiment, the phase delay of the first half cycle of phase modulated output signal $V_{\Phi}$ is controlled by the value selectable current $I_1$. During each first half cycle of mains voltage $V_{mains}$, diode 302 conducts current $I_1$, and current $I_1$ charges capacitor 110. When capacitor 110 charges to a voltage greater than a trigger voltage of diac 114, the diac 114 conducts and the gate of triac 116 charges. The resulting voltage at the gate of triac 116 and across bias resistor 118 causes the triac 116 to conduct until current $I_1$ falls to zero at the end of the first half cycle of mains voltage $V_{mains}$. The elapsed time between the beginning of the half cycle and when the triac 116 begins to conduct represents a leading edge phase delay. When the triac 116 is nonconductive, the phase modulated output signal $V_{\Phi}$ is 0 V. When triac 116 conducts a leading edge is generated, and the output voltage $V_{OUT}$ equals the mains voltage $V_{mains}$. The conduction time of triac 116 during the first half cycle of mains voltage $V_{mains}$ is directly related to the charge time of capacitor 110 and is, thus, directly related to the value of current $I_1$. The conduction time of triac 116 during the first half cycle of mains voltage $V_{mains}$ directly controls a leading edge phase delay of the first half cycle of output voltage $V_{OUT}$. Thus, the value of current $I_1$ directly corresponds to the phase delay of the first half cycle of phase modulated output signal $V_m$.

The resistor 112 and variable resistor 304 control the value of current $I_1$ during each first half cycle of mains voltage $V_{mains}$. Thus, the value of current $I_1$ is selectable by changing the resistance of variable resistor 304. Therefore, varying selectable current $I_1$ varies the leading edge phase delay of the first half cycle of phase modulated output signal $V_{\Phi}$.

The leading edge phase delay of the negative cycle of phase modulated output signal $V_{\Phi}$ is controlled by selectable current $I_2$. During each negative cycle of mains voltage $V_{mains}$, diode 306 conducts current $I_2$, and current $I_2$ charges capacitor 110. When capacitor 110 charges to a voltage greater than a trigger voltage of diac 114, the diac 114 conducts and the gate of triac 116 charges. The resulting voltage at the gate of triac 116 and across bias resistor 118 causes the triac 116 to conduct until current $I_2$ falls to zero at the end of the negative cycle of mains voltage $V_{mains}$. When triac 116 begins to conduct, a leading edge of the second half cycle of phase modulated output signal $V_{\Phi}$ is generated. The elapsed time between the beginning of the second half cycle and the leading edge of the second half cycle represents a leading edge phase delay of the second half cycle. The conduction time of triac 116 during the second half cycle of mains voltage $V_{mains}$ is directly related to the charge time of capacitor 110 and is, thus, directly related to the value of current $I_2$. The conduction time of triac 116 during the second half cycle of mains voltage $V_{mains}$ directly controls the leading edge phase delay of the second half cycle of phase modulated output signal $V_{\Phi}$. Thus, the value of current $I_2$ directly corresponds to the leading edge phase delay of the second half cycle of phase modulated output signal $V_{\Phi}$.

The resistance value of variable resistor 304 is set by input A. The resistance value of variable resistor 306 is set by input B. In at least one embodiment, variable resistor 304 is a potentiometer with a mechanical wiper. The resistance of variable resistor 304 changes with physical movement of the wiper. In at least one embodiment, variable resistor 304 is implemented using semiconductor devices to provide a selectable resistance. In this embodiment, the input A is a control signal received from a controller. The controller set input A in response to an input, such as a physical button depression sequence, a value received from a remote control device, and/or a value received from a timer or motion detector. The source or sources of input A can be manual or any device capable of modifying the resistance of variable resistor 304. In at least one embodiment, variable resistor 306 is the same as variable resistor 304. As with input A, the source of input B can be manual or any device capable of modifying the resistance of variable resistor 306. The output voltage $V_{OUT}$ is provided as an input to phase delay detector 310. Phase delay detector 310 detects the phase delays of phase modulated output signal $V_\Phi$ and generates a digital dimmer output signal value $D_{V.X}$ for each independently generated phase delay per cycle. X is an integer index value ranging from 0 to M, and M+1 represents the number of independently generated phase delays per cycle of phase modulated output signal $V_\Phi$. In at least one embodiment, M ranges from 1 to 3. Dimmer signals $D_{V.0}, \ldots, D_{V.M}$ are collectively represented by "$D_V$". The values of digital dimmer output signals $D_v$ can be used to generate control signals and drive currents.

Figure 3B:
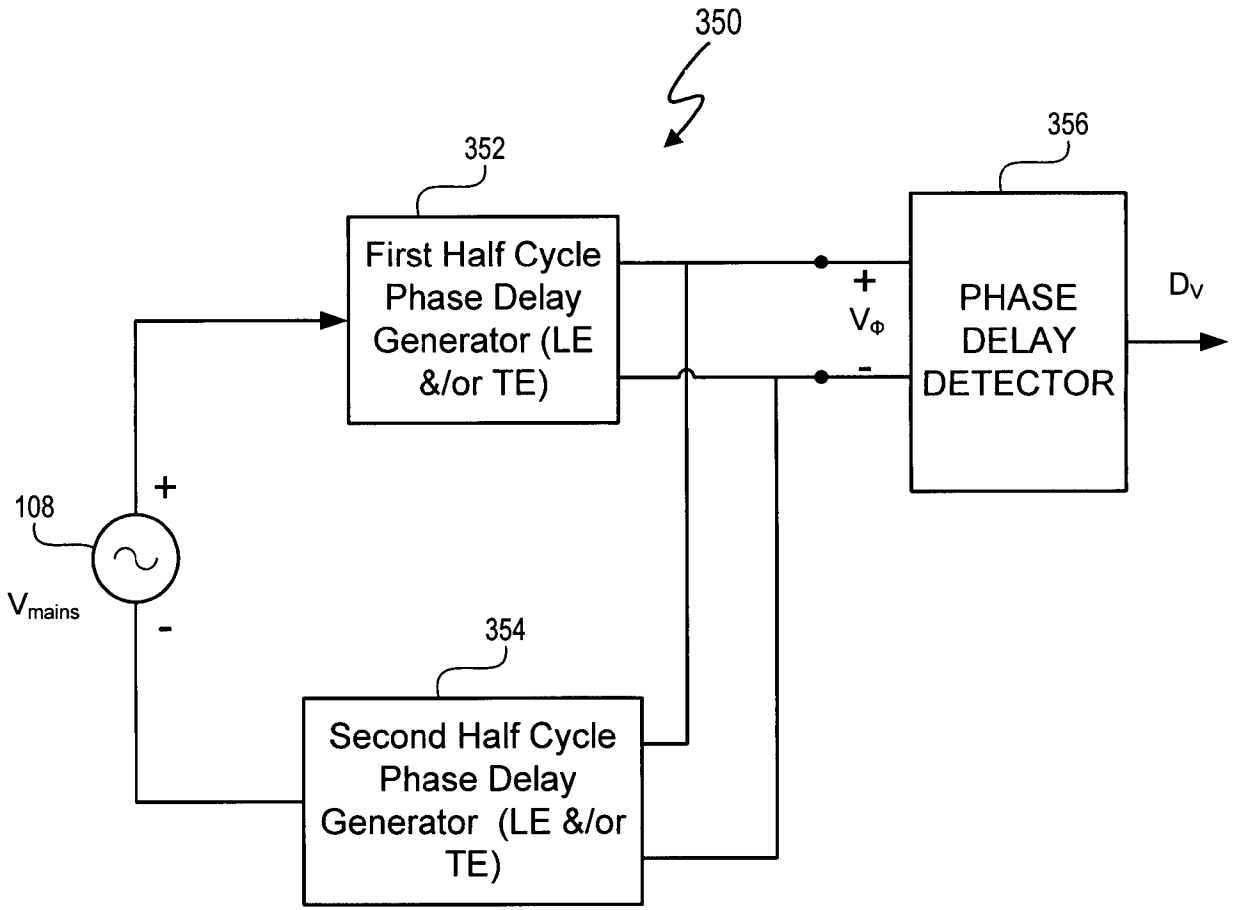
FIG. 3B depicts another duty cycle modifier.

FIG. 3B depicts a phase modulator 350 that independently or dependently modifies the leading edge (LE) and/or trailing edges (TE) of mains voltage $V_{mains}$ to generate 2 to 4 phase delays representing 2 to 4 items of information per cycle of phase modulated output signal $V_\Phi$ The number of independent phase delays generate by phase modulator 350 is a matter of design choice. The phase modulator 300 represents one embodiment of the phase modulator 350. The first half cycle phase delay generator 352 generates phase delays in the first half cycle of input signal $V_{mains}$ by chopping the mains voltage $V_{mains}$ to generate a leading edge, trailing edge, or both the leading and trailing edges of phase modulated output signal $V_\Phi$. The second half cycle phase delay generator 354 generates phase delays in the second half cycle of input signal $V_{mains}$ by chopping the mains voltage $V_{mains}$ to generate a leading edge, trailing edge, or both the leading and trailing edges of phase modulated output signal $V_\Phi$. Thus, depending upon the configuration of phase modulator 350, two to four independent items of data are generated per each cycle of the input signal $V_{mains}$.

The input mains voltage $V_{mains}$ can be chopped to generate both leading and trailing edges as for example described in U.S. Pat. No. 6,713,974, entitled "Lamp Transformer For Use With An Electronic Dimmer And Method For Use Thereof For Reducing Acoustic Noise", inventors Patchornik and Barak. U.S. Pat. No. 6,713,974 describes an exemplary system and method for leading and trailing edge voltage chopping and edge detection. U.S. Pat. No. 6,713,974 is incorporated herein by reference in its entirety.

FIGS. 4A, 4B, 4C, and 4D depict exemplary respective waveforms 400A, 400B, 400C, and 400D of phase modulated output signal $V_\Phi$. The waveforms 400A, 400B, 400C, and 400D represent cycles of a phase modulated mains voltage $V_\Phi$. The waveforms 400A, 400B, 400C, and 400D each include between 2 and 4 independently generated phase delays per cycle. Leading edge phase delays are represented by "a" (alpha), and trailing edge delays are represented by "(3" (beta).

FIG. 4A depicts leading and trailing edge phase delays of two exemplary cycles 402A.0 and 402A.N of the waveform 400A of phase modulated output signal $V_\Phi$. Each cycle of leading edge phase delays al generated in the first and second half cycles 404A.0 and 406A.0, respectively, independently of the trailing edge phase delays β1 of the first and second half cycles 404A.0 and 406A.0. The second half cycle repeats the first half cycle, so the two leading edge phase delays are not independent, and the two trailing edge phase delays are also not independent.

As previously discussed, the leading edge phase delays represent the elapsed time between a beginning of a half cycle and a leading edge of the phase modulated mains voltage $V_\Phi$. The trailing edge phase delays represent the elapsed time between a trailing edge of the phase modulated mains voltage $V_\Phi$ and the end of a half cycle. An exemplary determination of the phase delays for waveform 400A is set forth below. The phase delays for waveforms 400B-400D are similarly determined and subsequently set forth in Table 2.

In the first half cycle 404A.0, leading edge phase delay is the elapsed time between the occurrence of the first half cycle 404A.0 leading edge at time $t_1$ and the beginning of the first half cycle 404A.0 at time $t_0$, i.e. the first half cycle 404A.0 leading edge phase delay $\alpha 1 = t_1 - t_0$. In the second half cycle 406A.0, leading edge phase delay $\alpha 1 = t_4 - t_3 = t_1 - t_0$.

In the first half cycle 404A.0, trailing edge phase delay is the elapsed time between the occurrence of the first half cycle 404A.0 trailing edge at time $t_2$ and the end of the first half cycle at time $t_3$, i.e. the first half cycle 404A.0 of trailing edge phase delay $\beta_1 = t_3 - t_2$. In the second half cycle 406A.0, leading edge phase delay $\beta_1 = t_6 - t_5 = t_3 - t_2$.

The phase modulator 350 generates new leading edge phase delays al and trailing edge phase delays β1 for cycle 402A.N. As with cycle 402A.N, the leading edges phase delays al of the first and second half cycles 404A.N and 406A.N are not generated independently of each other but are generated independently of trailing edge phase delays β1. Likewise, the trailing edges phase delays β1 of the first and second half cycles 404A.N and 406A.N are not generated independently of each other but are generated independently of leading edge phase delays α1. Accordingly, the phase delays of each cycle of waveform 400A represent two items of information.

In at least one embodiment, waveform 400A is generated with identical leading edge phase delays for the first and second half cycles of each cycle of phase modulated output signal $V_\Phi$ and identical trailing edge phase delays for the first and second half cycles of each cycle of phase modulated output signal $V_\Phi$ because the symmetry between the first half cycle 404A.X and the second half cycle 406A.X facilitates keeping dimmer output signals $D_V$ free of DC signals. In an application with a large current drain due to lighting equipment, in at least one embodiment, it is also desirable to protect a mains transformer (not shown) from excessive DC current. In at least one embodiment, waveforms such as waveform 400A, that have first half cycles with approximately the same area as second half cycles facilitate keeping dimmer output signals $D_V$ free of DC signals.

Figure 4B:
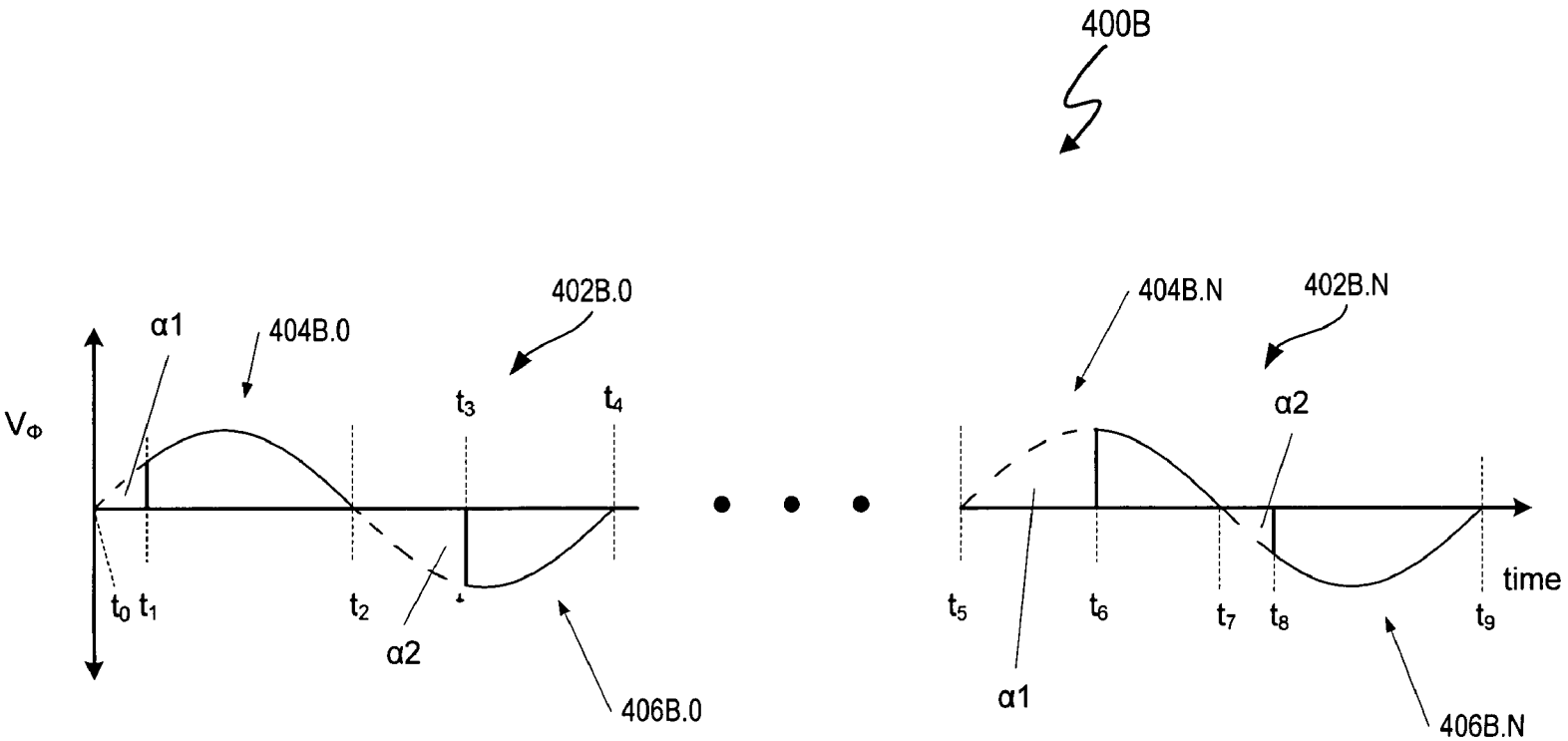

FIG. 4B depicts independently generated leading edge phase delays of two exemplary cycles 402B.0 and 402B.N of the waveform 400B of phase modulated output signal $V_\Phi$. Full cycle 402B.0 is composed of first half cycle 404B.0 and second half cycle 406B.0. Full cycle 402B.N is composed of first half cycle 404B.N and second half cycle 406B.N. Waveform 400B depicts the independent generation of a first half cycle leading edge phase delay al and a second half cycle leading edge phase delay α2.

Figure 4C:
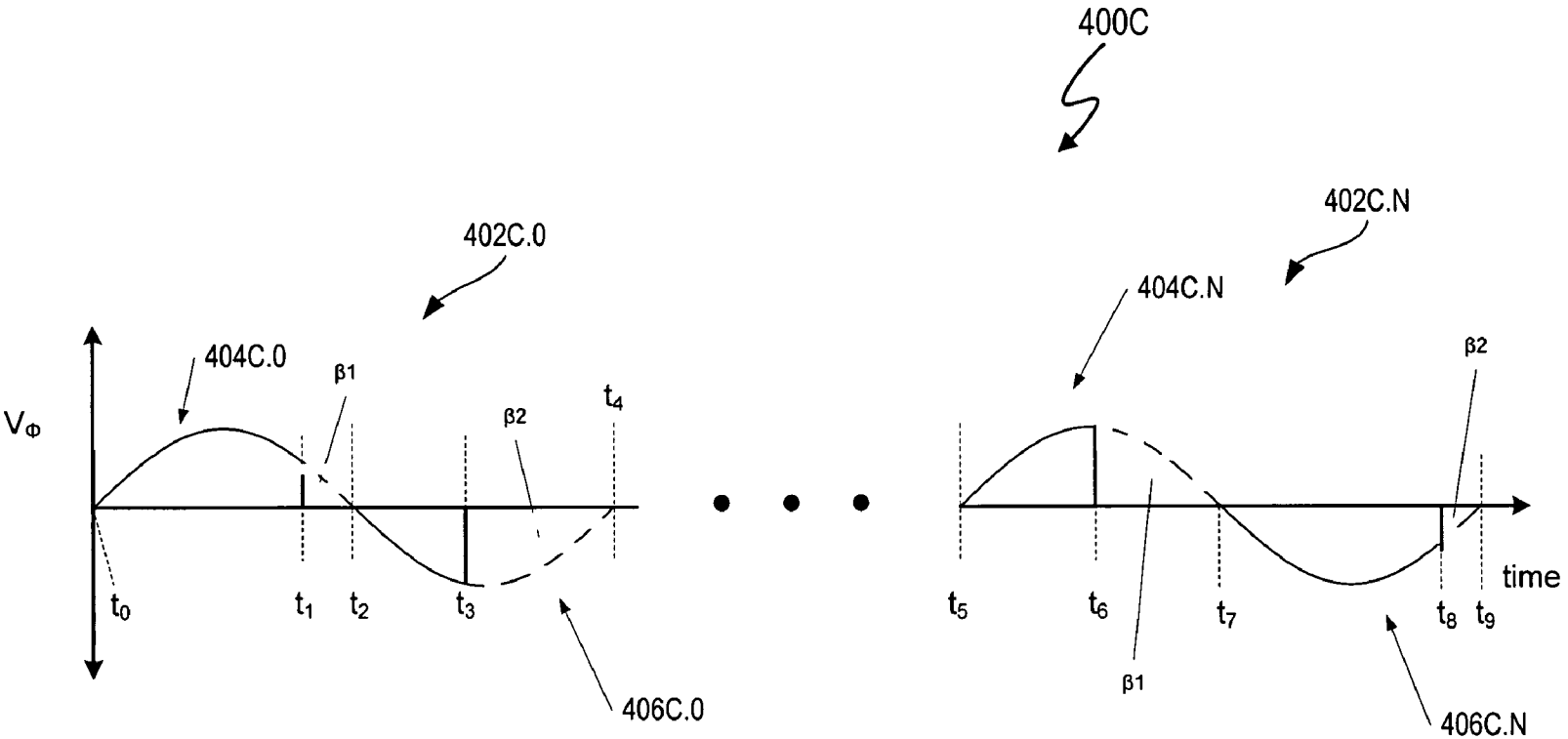

FIG. 4C depicts independently generated trailing edge phase delays of two exemplary cycles 402C.0 and 402C.N of the waveform 400C of phase modulated output signal $V_\Phi$. Full cycle 402C.0 is composed of first half cycle 404C.0 and second half cycle 406C.0. Full cycle 402C.N is composed of first half cycle 404C.N and second half cycle 406C.N. Waveform 400C depicts the independent generation of a first half cycle trailing edge phase delay β1 and a second half cycle trailing edge phase delay β2.

Figure 4D:
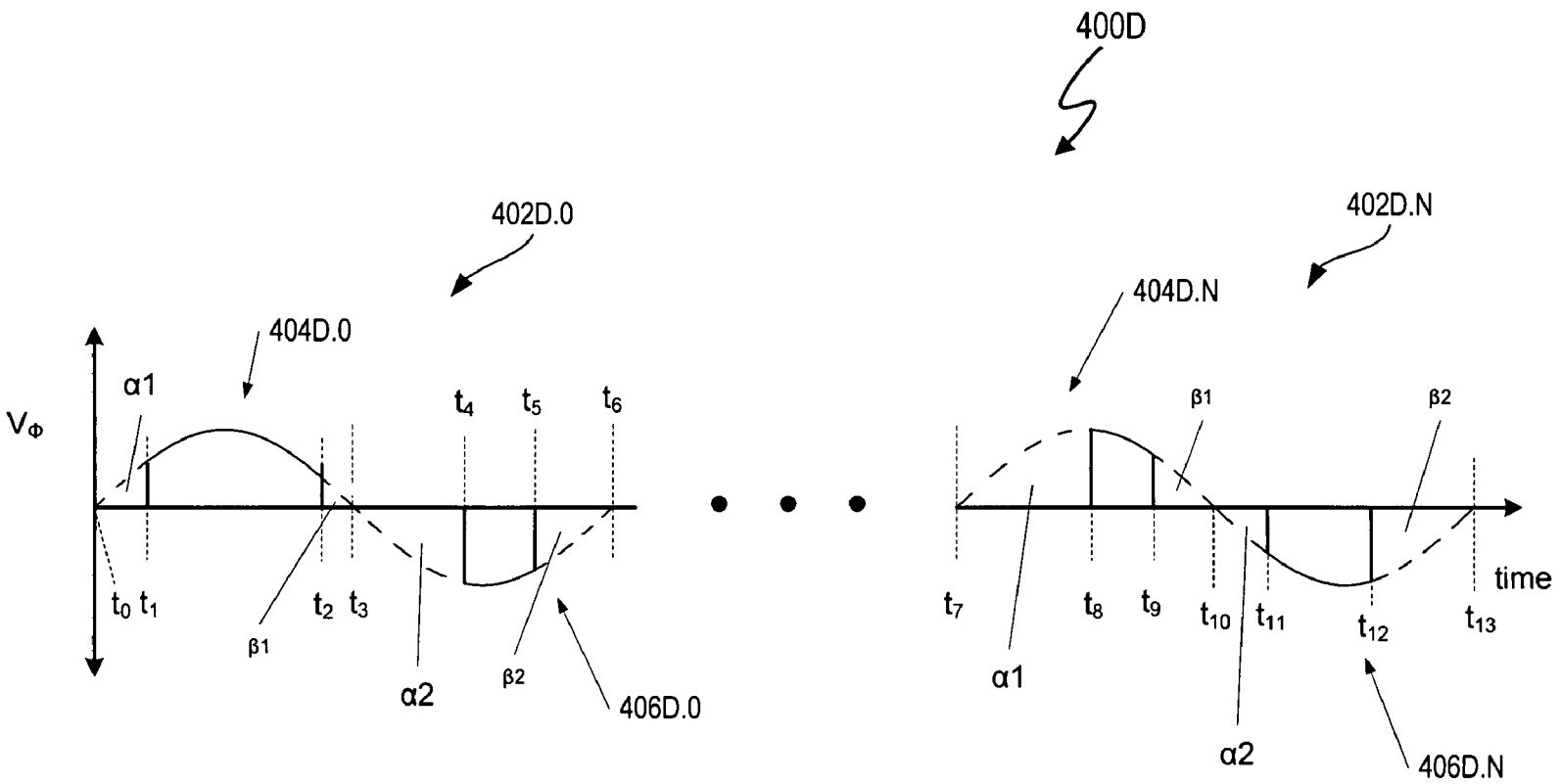

FIG. 4D depicts independently generated leading edges and trailing edges for both half cycles of two exemplary cycles 402D.0 and 402D.N of the waveform 400D of phase modulated output signal $V_\Phi$. Full cycle 402D.0 is composed of first half cycle 404D.0 and second half cycle 406D.0. Full cycle 402D.N is composed of first half cycle 404D.N and second half cycle 406D.N. Waveform 400D depicts the independent generation of a first half cycle leading edge phase delay $\alpha 1$, a first half cycle trailing edge phase delay $\beta 1$, a second half cycle leading edge phase delay $\alpha 2$, and a second half cycle trailing edge phase delay $\beta 2$.

(59) Table 1 sets forth the phase delays and corresponding time values of waveforms 400A-400D:

TABLE 1

| Cycles & Half Cycles | Phase Delay |
|---|---|
| 402A.0 | $\alpha 1 = (t_1 - t_0) = (t_4 - t_3)$ |
| 402A.0 | $\beta 1 = (t_3 - t_2) = (t_6 - t_5)$ |
| 402A.N | $\alpha 1 = (t_8 - t_7) = (t_6 - t_{10})$ |
| 402A.N | $\beta 1 = (t_{10} - t_9) = (t_{13} - t_{12})$ |
| 402B.0 | $\alpha 1 = (t_1 - t_0)$ |
| 402B.0 | $\alpha 2 = (t_3 - t_2)$ |
| 402B.N | $\alpha 1 = (t_6 - t_5)$ |
| 402B.N | $\alpha 2 = (t_8 - t_7)$ |
| 402C.0 | $\beta 1 = (t_2 - t_1)$ |
| 402C.0 | $\beta 2 = (t_4 - t_3)$ |
| 402C.N | $\beta 1 = (t_7 - t_6)$ |
| 402C.N | $\beta 2 = (t_9 - t_8)$ |
| 404D.0 | $\alpha 1 = (t_1 - t_0)$ |
| 404D.0 | $\beta 1 = (t_3 - t_2)$ |
| 406D.0 | $\alpha 2 = (t_4 - t_3)$ |
| 406D.0 | $\beta 2 = (t_6 - t_5)$ |
| 404D.N | $\alpha 1 = (t_7 - t_8)$ |
| 404D.N | $\beta 1 = (t_{10} - t_9)$ |
| 406D.N | $\alpha 2 = (t_{11} - t_{10})$ |
| 406D.N | $\beta 2 = (t_{13} - t_{12})$ |

The independent phase delays of the first half cycle and the second half cycle of each waveform of phase modulated output signal $V_\Phi$ represent independent items of information. The waveforms 400A, 400B, and 400C each have two independent items of information per cycle of phase modulated output signal $V_\Phi$. The waveform 400D has four independent items of information per cycle of phase modulated output signal $V_\Phi$.

Table 2 depicts the independent items of information available from the phase delays for each cycle of each depicted waveform of phase modulated output signal

TABLE 2

| Waveform | Information |
|---|---|
| 400A | $\alpha 1, \beta 1$ |
| 400B | $\alpha 1, \alpha 2$ |
| 400C | $\beta 1, \beta 2$ |
| 400D | $\alpha 1, \beta 1, \alpha 2, \beta 2$ |

Figure 4E:
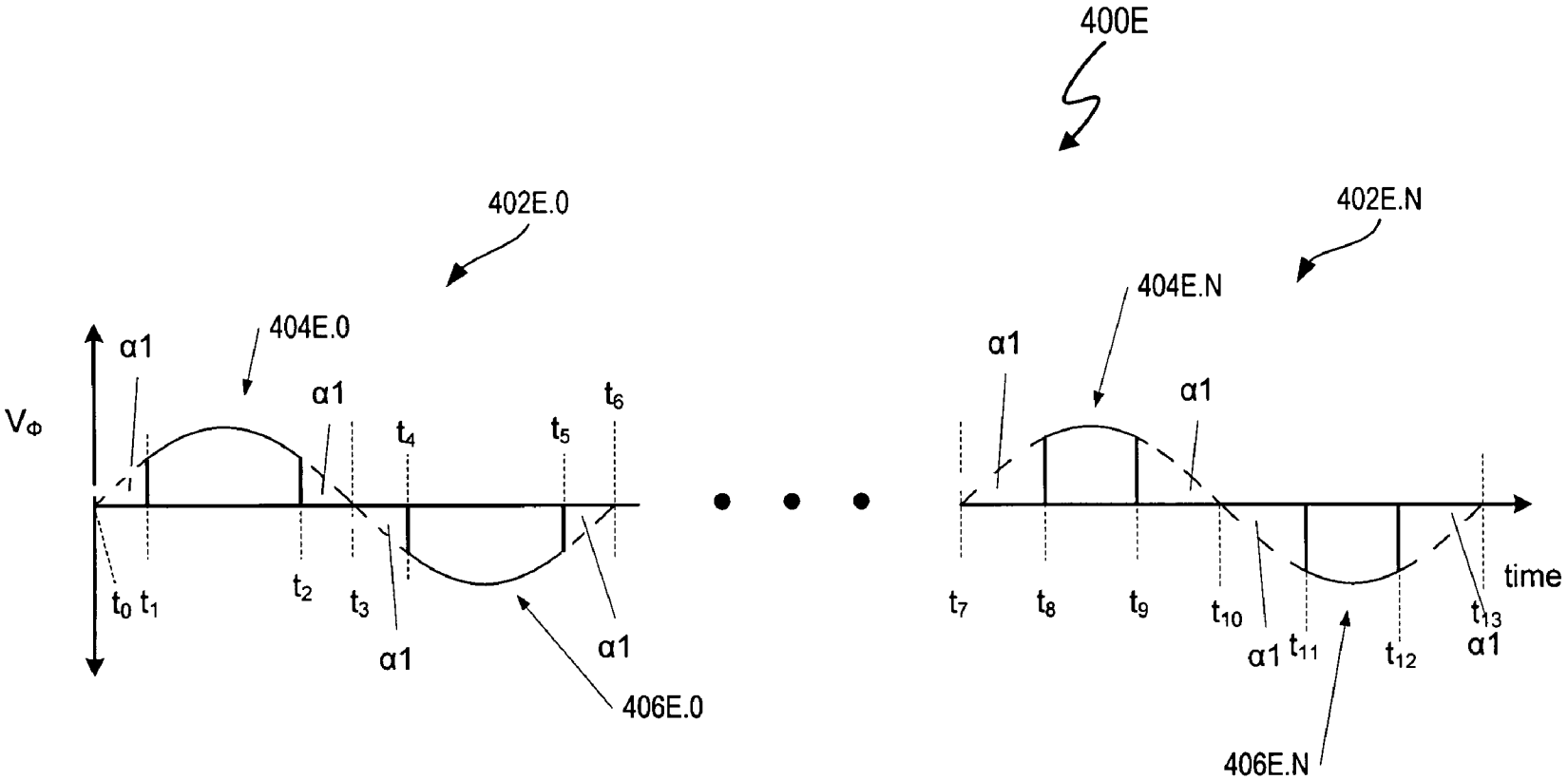
FIG. 4E depicts a phase modulated signal with symmetric leading and trailing edges.

FIG. 4E depicts a waveform 400E representing an exemplary phase modulated output signal $V_\Phi$ with four dependent phase delays per cycle but only one item of information per cycle. The two depicted cycles 402E.0 and 402E.N each have respective half cycles 404E.0 & 406E.0 and 404E.N & 406E.N. The leading and trailing edges of each half cycle have a phase delay of al. Although, the waveform 400E only includes one independent phase delay al, the symmetry of the leading and trailing edges of each cycle of waveform 400E make detection of the phase delay al relatively easy compared to detection of leading edge only or trailing edge only phase delays. Additionally, the symmetry of waveform 400E facilitates keeping dimmer output signal $D_V$ free of DC signals.

The individual items of information from each cycle can be detected, converted into data, such as digital data, and used to generate respective control signals. The control signals can, for example, be converted into separate current drive signals for light sources in a lighting device and/or used to implement predetermined functions, such as actuating predetermined dimming levels in response to a particular dimming level or in response to a period of inactivity of a dimmer, etc.

Figure 3C:
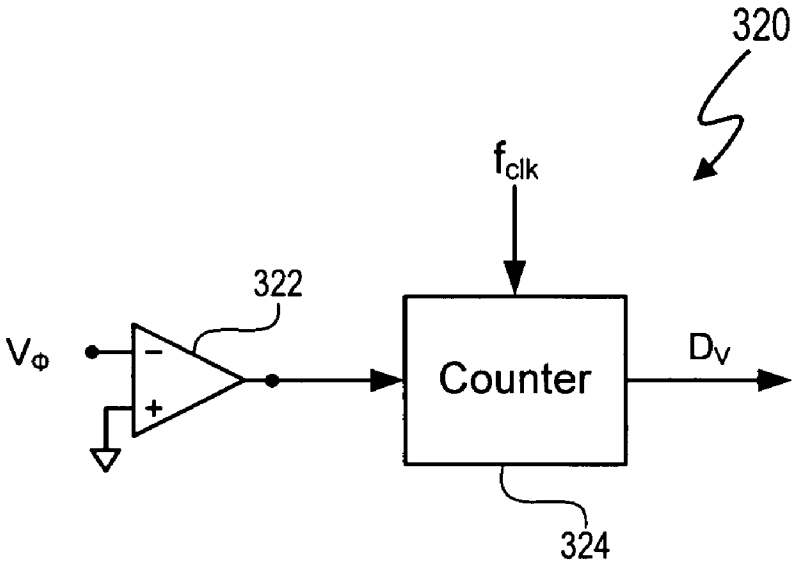
FIG. 3C depicts a phase delay detector.

FIG. 3C depicts a phase delay detector 320 to determine phase delays of leading and trailing edges of phase modulated output signal $V_\Phi$. Phase delay detector 320 represents one embodiment of phase delay detector 356. Comparator 322 compares phase modulated output signal $V_\Phi$ against a known reference. The reference is generally the cycle cross-over point voltage of phase modulated output signal $V_\Phi$, such as a neutral potential of a household AC voltage. The counter 324 counts the number of cycles of clock signal $f_{clk}$ that occur until the comparator 322 indicates that an edge of phase modulated output signal $V_\Phi$ has been reached. Since the frequency of phase modulated output signal $V_\Phi$ and the frequency of clock signal $f_{clk}$ are known, a leading edge phase delay can be determined from the count of cycles of clock signal $f_{clk}$ that occur from the beginning of a half cycle until the comparator 322 indicates the leading edge of phase modulated output signal $V_\Phi$. Likewise, the trailing edge of each half cycle can be determined from the count of cycles of clock signal $f_{clk}$ that occur from a trailing edge until an end of a half cycle of phase modulated output signal $V_\Phi$. The counter 324 converts the phase delays into digital dimmer output signal values $D_V$ for each cycle of phase modulated output signal $V_\Phi$.

Figure 3D:
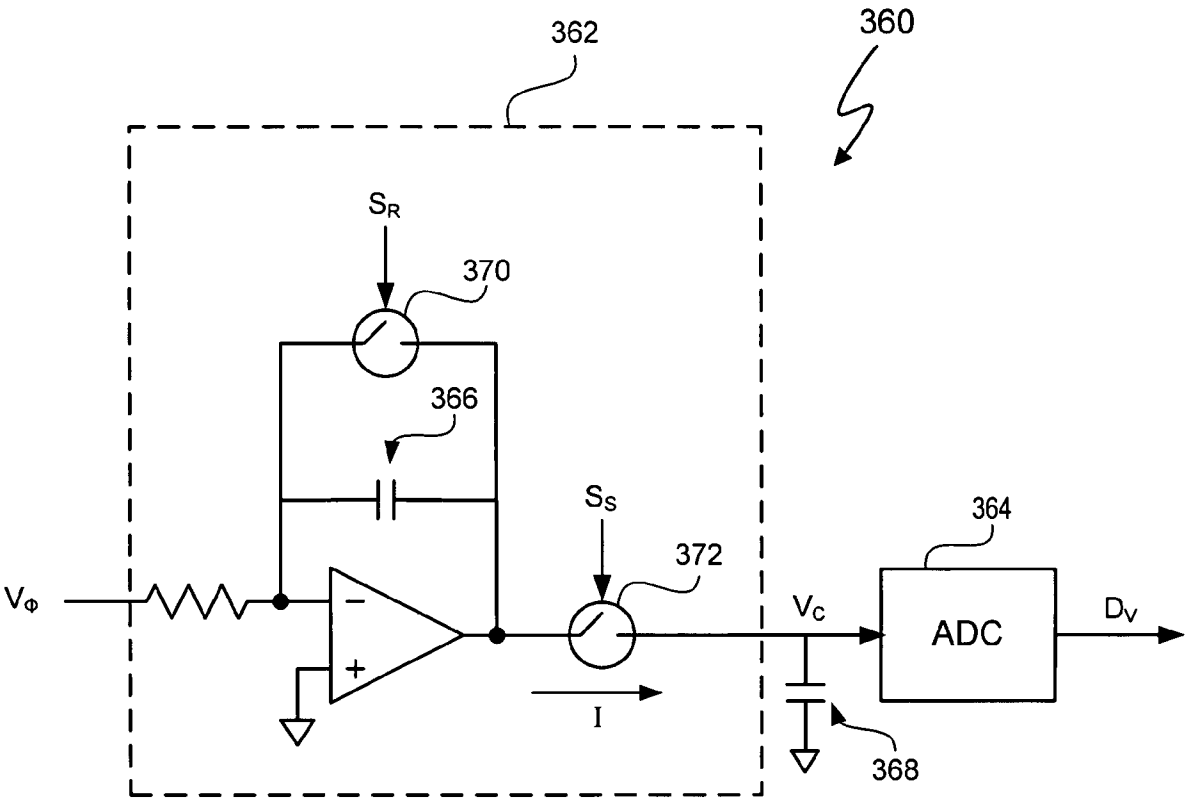
FIG. 3D depicts another phase delay detector.

FIG. 3D depicts a phase delay detector 360. Phase delay detector 360 represents one embodiment of phase delay detector 356 in FIG. 3B. The phase delay detector 360 includes an analog integrator 362 that integrates dimmer output signal $V_{DIM}$ during each cycle (full or half cycle) of phase modulated output signal $V_\Phi$. The analog integrator 362 generates a current I corresponding to the duty cycle of phase modulated output signal $V_\Phi$ for each cycle of phase modulated output signal $V_\Phi$. The current provided by the analog integrator 362 charges a capacitor 368 to threshold voltage $V_C$, and the voltage $V_C$ across capacitor 368 can be determined by analog-to-digital converter (ADC) 364. The analog integrator 362 can be reset after each cycle of phase modulated output signal $V_\Phi$ by discharging capacitors 366 and 368. Switch 370 includes a control terminal to receive reset signal $S_R$. Switch 372 includes a control terminal to receive sample signal $S_S$. The charge on capacitor 368 is sampled by capacitor 366 when control signal $S_S$ causes switch 372 to conduct. After sampling the charge on capacitor 368, reset signal $S_R$ opens switch 370 to discharge and, thus, reset capacitor 368. In at least one embodiment, switches 370 and 372 are n-channel field effect transistors, and sample signal $S_S$ and reset signal $S_R$ have non-overlapping pulses. In at least one embodiment, each cycle of dimmer output signal $V_{DIM}$ can be detected by every other zero crossing of dimmer output signal $V_{DIM}$.

Figure 5:
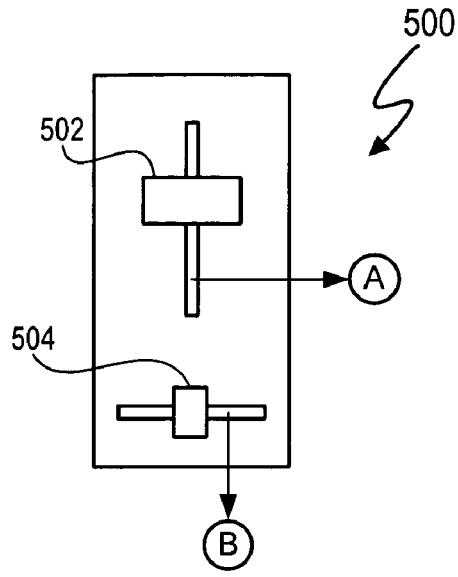
FIG. 5 depicts one embodiment of a dimmer for controlling two functions of a lighting circuit.
Figure 6:
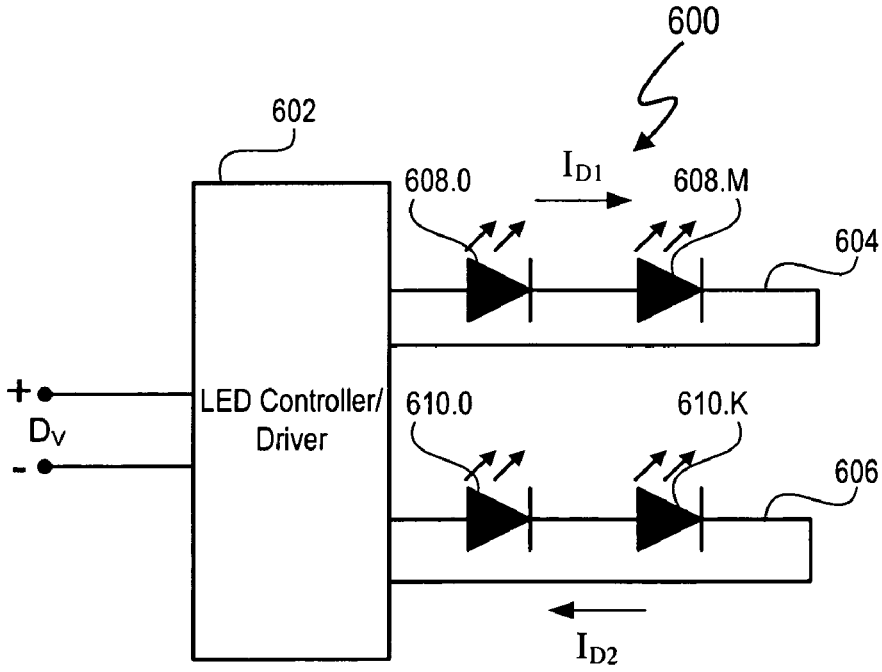
FIG. 6 depicts a lighting circuit.

The phase modulators 300 and 350 can be used in a variety of applications such as applications where the phase delays of a waveform provides a control input. FIG. 5 depicts one embodiment of a dimmer 500 for controlling two functions of a lighting circuit, such as lighting circuit 600 (FIG. 6). In one embodiment, dimmer 500 represents one embodiment of the phase modulator 300, in another embodiment, dimmer 500 represents one embodiment of the phase modulator 350. The dimmer includes two slideable switches 502 and 504. In at least one embodiment, moving switch 502 vertically provides an input A, which selects the value of selectable current $I_1$ by varying the resistance of variable resistor 304. In at least one embodiment, moving switch 504 horizontally provides an input B, which selects the value of selectable current $I_2$ by varying the resistance of variable resistor 306. Thus, in at least one embodiment, switches 502 and 504 control the phase delays of respective positive and second half cycles of phase modulated output signal $V_\Phi$ (FIG. 3).

FIG. 6 depicts an exemplary lighting circuit 600. The lighting circuit 600 represents one embodiment of a load for phase modulator 300. The lighting circuit 600 includes a LED Controller/Driver circuit 602 that responds to digital data $D_V$. The items of information derived from phase delays of phase modulated output signal $V_\Phi$ and represented by the digital data $D_V$ can be converted into respective control signals for controlling, for example, the drive currents to LED bank 604. LED bank 604 includes one or more LEDs 608.0 through 608.M, where M is a positive integer. LED bank 606 includes one or more LEDs 610.0 through 610.K, where K is a positive integer. The LED Controller/Driver circuit 602 provides drive currents $I_{D1}$ and $I_{D2}$ to respective LED banks 604 and 606 to control the intensity of each LED in LED banks 604 and 606. In at least one embodiment, the average values of the drive currents $I_{D1}$ and $I_{D2}$ directly correspond to the respective phase delays of the first and second half cycles of phase modulated output signal $V_\Phi$. Thus, the intensity of LED banks 604 and 606 can be varied independently. In at least one embodiment, the LED banks 604 and 606 contain different colored LEDs. Thus, varying the intensity of LED banks 604 and 606 also varies the blended colors produced by LED banks 604 and 606.

Exemplary embodiments of LED Controller/Driver circuit 602 are described in Melanson I, Melanson II, Melanson V, and Melanson VII.

Figure 7:
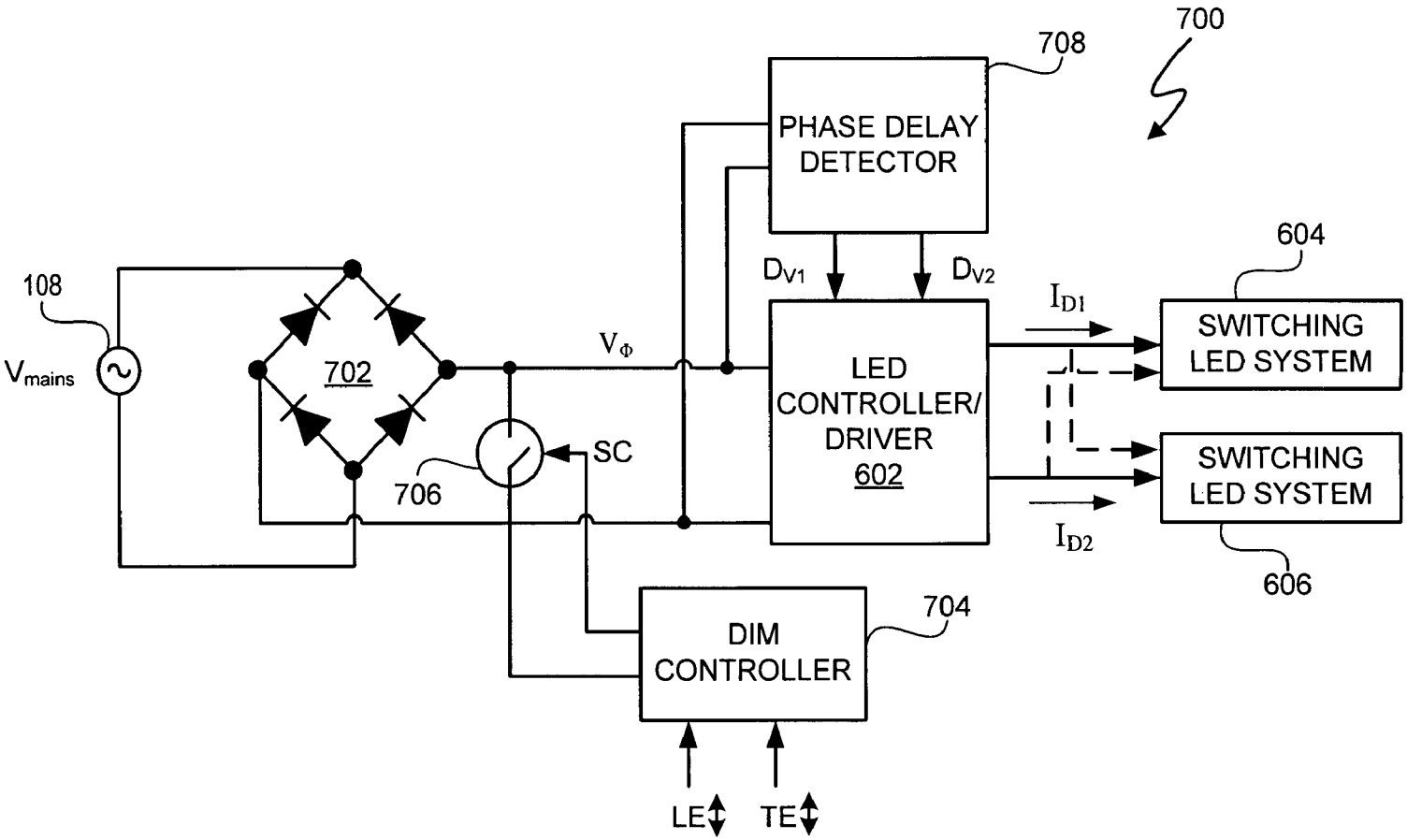
FIG. 7 depicts a light emitting diode (LED) lighting and power system.

FIG. 7 depicts a light emitting diode (LED) lighting and power system 700. The lighting and power system 700 utilizes phase delays of a phase modulated output signal $V_\Phi$ to generate independently determined LED drive currents. A full diode bridge 702 rectifies the AC mains voltage $V_{mains}$. The dim controller 704 receives leading edge LE and trailing edge TE phase delay inputs. In at least one embodiment, the leading edge LE and trailing edge TE inputs represent signals specifying the leading edge and trailing edge phase delays of each half cycle of phase modulated output signal $V_\Phi$ in accordance with waveform 400A. In other embodiments, dim controller 704 receives inputs to generate phase delays in accordance with waveforms 400B, 400C, 400D, or 400E. The dim controller 704 generates a chopping control signals SC. The chopping control signal SC causes switch 706 to switch ON and OFF, where "ON" is conductive and "OFF" is nonconductive. When switch 706 is ON, the phase modulated output signal $V_\Phi$ equals zero, and when switch 706 is OFF, phase modulated output signal $V_\Phi$ equals $V_{mains}$. Thus, dim controller 704 generates a leading edge phase delay when switch 706 transitions from ON to OFF and generates a trailing edge phase delay when switch 706 transitions from OFF to ON.

The phase delay detector 708 detects the phase delays of phase modulated output signal $V_\Phi$ and generates respective digital data dimmer signals $D_{V1}$ and $D_{V2}$. In at least one embodiment, the phase delay detector 708 can be any phase delay detector, such as phase delay detector 320 or phase delay detector 360. The digital data dimmer signals $D_{v1}$ and $D_{v2}$ represent respective items of information derived from the phase delays of each cycle of phase modulated output signal $V_\Phi$ as, for example, set forth in Table 2. In at least one embodiment, the digital data dimmer signals $D_{V1}$ and $D_{V2}$ are mapped to respective dimming levels in accordance with Melanson III.

The LED controller/driver 602 converts the digital data dimmer signals $D_{V1}$ and $D_{v2}$ into respective control signals $I_{D1}$ and $I_{D2}$. In at least one embodiment, control signals $I_{D1}$ and $I_{D2}$ are LED drive currents $I_{D1}$ and $I_{D2}$. In at least one embodiment, LED controller/driver 602 generates LED drive currents $I_{D1}$ and $I_{D2}$ in accordance with Melanson IV. In at least one embodiment, LED controller/driver 602 includes a switching power converter that performs power factor correction on the phase modulated output signal $V_\Phi$ and boosts the phase modulated output signal $V_\Phi$ to an approximately constant output voltage as, for example, described in Melanson V and Melanson VI. The LED drive currents $I_{D1}$ and $I_{D2}$ provide current to respective switching LED systems 604 and 606. The switching LED systems 604 and 606 each include one or more LEDs. In at least one embodiment, the control signals $I_{D1}$ and $I_{D2}$ cause each switching LED systems 604 and 606 to operate independently. In at least one embodiment, the control signals $I_{D1}$ and $I_{D2}$ are both connected to each of switching LED systems 604 and 606 (as indicated by the dashed lines) and cause each switching LED systems 604 and 606 to operate in unison with two different functions. For example, control signal $I_{D1}$ can adjust the brightness of both switching LED systems 604 and 606, and control signal $I_{D2}$ can adjust a color temperature of both switching LED systems 604 and 606

Thus, in at least one embodiment, the phase modulator 300 generates a phase modulated output signal with 2 to 4 independent phase delays for each cycle of the phase modulated output signal. Each independent phase delay per cycle represents an independent item of information. In at least one embodiment, detected, independent phase delays can be converted into independent control signals. The control signals can be used to control drive currents to respective circuits, such as respective sets of light emitting diodes.

Although the present invention has been described in detail, it should be understood that various changes, substitutions and alterations can be made hereto without departing from the spirit and scope of the invention as defined by the appended claims.

What is claimed is:

1. An apparatus to generate at least two independent signals in response to at least two independent items of information derived from at least two independently generated phase delays per cycle of a phase modulated mains voltage signal, the apparatus comprising:

a phase delay detector to detect at least two independently generated phase delays per cycle of the phase modulated mains voltage signal and to generate respective data signals, wherein each data signal represents an item of information conforming to one of the phase delays; and a controller, coupled to the phase delay detector, to receive the data signals and, for each received data signal, to generate a control signal in conformity with the item of information represented by the data signal.

2. The apparatus of claim 1 wherein each cycle of the phase modulated mains voltage signal includes a first half cycle and a second half cycle, the phase modulated mains voltage signal includes leading edge phase delays for the first and second half cycles, and the leading edge phase delays represent independent items of information.

3. The apparatus of claim 1 wherein each cycle of the phase modulated mains voltage signal includes a first half cycle and a second half cycle, the phase modulated mains voltage signal includes trailing edge phase delays for the first and second half cycles, and the trailing edge phase delays represent independent items of information.

4. The apparatus of claim 1 wherein each cycle of the phase modulated mains voltage signal includes a first half cycle and a second half cycle, the phase modulated mains voltage signal includes leading edge phase delays for the first and second half cycles and trailing edge phase delays for the first and second half cycles, wherein each leading edge phase delay and each trailing edge phase delay represent independent items of information.

5. The apparatus of claim 1 wherein each cycle of the phase modulated mains voltage signal includes a first half cycle and a second half cycle, the phase modulated mains voltage signal includes leading edge phase delays for the first and second half cycles and trailing edge phase delays for the first and second half cycles, wherein the leading edge phase delays represent a first item of information and the trailing edge phase delays represent a second item of information that is independent of the first item of information.

6. The apparatus of claim 1 further comprising:

a light emitting diode (LED) driver, coupled to the controller, to receive each duty cycle modulated control signal and, for each received control signal, to generate an approximately constant LED drive current having a direct current (DC) offset that is proportional to the duty cycle of the duty cycle modulated control signal.

7. The apparatus of claim 6 further comprising:

a first LED set of at least one light emitting diodes (LEDs) coupled to the LED driver; and a second LED set of at least one LEDs coupled to the LED driver.

8. The apparatus of claim 1 wherein the phase modulated mains voltage signal is a phase modulated dimming signal.

9. A method to generate at least two independent signals in response to at least two independent items of information derived from at least two independently generated phase delays per cycle of a phase modulated mains voltage signal, the method comprising:

detecting at least two independent phase delays per cycle of the phase modulated mains voltage signal, wherein each phase delay represents an independent item of information;

generating respective data signals, wherein each data signal represents an item of information conforming to one of the phase delays; and for each data signal, generating a control signal in conformity with the item of information represented by the data signal.

10. The method of claim 9 wherein each cycle of the phase modulated mains voltage signal includes a first half cycle and a second half cycle, the phase modulated mains voltage signal includes leading edge phase delays for the first and second half cycles, and the leading edge phase delays represent independent items of information.

11. The method of claim 9 wherein each cycle of the phase modulated mains voltage signal includes a first half cycle and a second half cycle, the phase modulated mains voltage signal includes trailing edge phase delays for the first and second half cycles, and the trailing edge phase delays represent independent items of information.

12. The method of claim 9 wherein each cycle of the phase modulated mains voltage signal includes a first half cycle and a second half cycle, the phase modulated mains voltage signal includes leading edge phase delays for the first and second half cycles and trailing edge phase delays for the first and second half cycles, wherein each leading edge phase delay and each trailing edge phase delay represent independent items of information.

13. The method of claim 9 wherein each cycle of the phase modulated mains voltage signal includes a first half cycle and a second half cycle, the phase modulated mains voltage signal includes leading edge phase delays for the first and second half cycles and trailing edge phase delays for the first and second half cycles, wherein the leading edge phase delays represent a first item of information and the trailing edge phase delays represent a second item of information that is independent of the first item of information.

14. The method of claim 9 further comprising:

receiving each duty cycle modulated control signal; and for each received control signal, generating an approximately constant LED drive current having a direct current (DC) offset that is proportional to the duty cycle of the duty cycle modulated control signal.

15. The method of claim 14 wherein generating an approximately constant LED drive current having a direct current (DC) offset that is proportional to the duty cycle of the duty cycle modulated control signal comprises generating first and second approximately constant LED drive currents, the method further comprising:

providing the first LED drive current to a first LED set of at least one light emitting diodes (LEDs) coupled to the LED driver; and providing the second LED drive current to a second LED set of at least one LEDs coupled to the LED driver.

16. The method of claim 9 wherein the phase modulated mains voltage signal is a phase modulated dimming signal.

* * * * *